US012186642B2

(12) United States Patent
Root et al.

(10) Patent No.: US 12,186,642 B2
(45) Date of Patent: Jan. 7, 2025

(54) SYSTEM AND METHOD FOR GOLF SUPER TAG MULTIFUNCTION GOLF SWING CAPTURE AND ANALYSIS DEVICE

(71) Applicant: SkyHawke Technologies, LLC, Ridgeland, MS (US)

(72) Inventors: Richard L. Root, Ridgeland, MS (US); Richard C. Edmonson, Ridgeland, MS (US); Gord Parke, Winnipeg (CA); Jeremy Rittenhouse, Lancaster, PA (US); Greg Breland, Alpharetta, GA (US)

(73) Assignee: SkyHawke Technologies, LLC, Ridgeland, MS (US)

( * ) Notice: Subject to any disclaimer, the term of this patent is extended or adjusted under 35 U.S.C. 154(b) by 158 days.

(21) Appl. No.: 17/987,442

(22) Filed: Nov. 15, 2022

(65) Prior Publication Data

US 2023/0149789 A1 May 18, 2023

Related U.S. Application Data

(60) Provisional application No. 63/279,576, filed on Nov. 15, 2021.

(51) Int. Cl.
*A63B 69/36* (2006.01)

(52) U.S. Cl.
CPC ..... *A63B 69/3632* (2013.01); *A63B 2220/40* (2013.01); *A63B 2220/833* (2013.01); *A63B 2225/50* (2013.01)

(58) Field of Classification Search
CPC ..... A63B 69/3632; A63B 2220/40; A63B 2220/833; A63B 2225/50
See application file for complete search history.

(56) References Cited

U.S. PATENT DOCUMENTS

| | | | | |
|---|---|---|---|---|
| 8,905,856 | B2 | 12/2014 | Parke et al. | |
| 8,998,717 | B2 | 4/2015 | Parke et al. | |
| 9,211,439 | B1 | 12/2015 | Pedenko et al. | |
| 9,395,385 | B2 | 7/2016 | Parke et al. | |
| 9,737,817 | B1 * | 8/2017 | Ricky | A63B 60/42 |
| 9,999,821 | B2 | 6/2018 | Yarmis et al. | |
| 10,589,161 | B2 | 3/2020 | Blanc | |
| 11,148,026 | B2 | 10/2021 | Syed et al. | |
| 11,219,814 | B2 | 1/2022 | Syed et al. | |
| 2017/0234706 | A1 | 8/2017 | Martin et al. | |
| 2017/0312572 | A1 * | 11/2017 | Thornton | A63B 69/3632 |
| 2018/0001184 | A1 * | 1/2018 | Tran | G16H 50/20 |
| 2018/0050254 | A1 | 2/2018 | Maani et al. | |
| 2020/0276488 | A1 * | 9/2020 | Cottam | G16H 40/63 |
| 2020/0398138 | A1 * | 12/2020 | Hendrix | A63F 13/812 |

(Continued)

FOREIGN PATENT DOCUMENTS

| | | | |
|---|---|---|---|
| EP | 3978949 | A2 | 4/2022 |
| WO | 2018204538 | A1 | 11/2018 |

*Primary Examiner* — Raleigh W Chiu
(74) *Attorney, Agent, or Firm* — NEO IP

(57) ABSTRACT

A system and device for capturing data associated with the characteristics of a golf swing through a plurality of sensors. The device is affixed to a golf club and captures data associated with the characteristics of a golf swing when the golf club is swung. The device utilizes a plurality of power states to vary the power levels provided to a plurality of sensors and computer components, as well as, communication to extend batter life of the device.

20 Claims, 20 Drawing Sheets

(56) References Cited

U.S. PATENT DOCUMENTS

| | | | | |
|---|---|---|---|---|
| 2021/0069568 | A1* | 3/2021 | Meadows | G06N 20/00 |
| 2021/0343390 | A1* | 11/2021 | Cohen | G09B 19/0038 |
| 2022/0161121 | A1 | 5/2022 | Syed et al. | |

* cited by examiner

SYSTEM AND METHOD FOR GOLF SUPER TAG MULTIFUNCTION GOLF SWING CAPTURE AND ANALYSIS DEVICE

CROSS REFERENCES TO RELATED APPLICATIONS

This application is related to and claims priority from one or more prior filed US patent applications. This application claims priority to and the benefit of U.S. Provisional Application No. 63/279,576, filed Nov. 15, 2021, which is incorporated herein by reference in its entirety.

BACKGROUND OF THE INVENTION

1. Field of the Invention

The present invention relates to a system, method, and device for data capture during golf play, measurement and visualization of golf swings that implement power saving mechanisms which do not impact collection or transmission of data, and communication protocols for data to extend the battery life of the device.

2. Description of the Prior Art

It is generally known in the art to provide a device to monitor, track, and/or analyze a golfer's performance during a round of golf using sensors associated with the golfer or the golf club.

Prior art patent documents include the following:

US Patent Pub. No. 2022/0161121 for Autonomous Tracking and Personalized Golf Recommendation and Analysis Environment by inventors Syed et al. filed Jan. 10, 2022 and published May 26, 2022, discloses systems, methods, and computer-readable media configured to autonomously track a round of golf and/or autonomously generate personalized recommendations for a user before, during, or after a round of golf. The systems and methods can utilize course data, environmental data, user data, and/or equipment data in conjunctions with one or more machine learning algorithms to autonomously generate the personalized recommendations.

U.S. Pat. No. 11,219,814 for Autonomous personalized golf recommendation and analysis environment by inventors Syed et al. filed Jun. 10, 2020 and issued Jan. 11, 2022, discloses systems, methods, and computer-readable media configured to autonomously generate personalized recommendations for a user before, during, or after a round of golf. The systems and methods can utilize course data, environmental data, user data, and/or equipment data in conjunctions with one or more machine learning algorithms to autonomously generate the personalized recommendations.

U.S. Pat. No. 10,589,161 for System and method for monitoring performance characteristics associated with user activities involving swinging instruments by inventor Blanc, filed Sep. 25, 2017 and issued Mar. 17, 2020, discloses various components of a system for monitoring and/or tracking a user's performance during an activity involving an instrument that is swung. Exemplary embodiments can include a sensor module configured to be secured to and/or embedded within the instrument. The sensor module can detect a swing event and/or an impact between the instrument and an object and can generate pressures waves that propagate through air. The pressure waves can include information or represent information about a use of the instrument and can be detected by an electronic device associated with the user, which can display the information, process the information, and/or transmit the information to a remote system. The pressure waves can be modulated to encode information within the pressure waves.

U.S. Pat. No. 9,999,821 for Method for monitoring performance characteristics associated with user activities involving swinging instruments by inventors Yarmis et al. filed Jul. 13, 2016 and issued Jun. 19, 2018, discloses methods for attachment of devices to a swinging instrument, the devices generally including a cover, a base, a chassis, and positive and negative electrical contacts. The base includes a fastening portion and a support portion. The chassis supports a printed circuit board. The devices include a cap configured and dimensioned to mate relative to the support portion of the base. The support portion can support the chassis, the printed circuit board, the positive and negative electrical contacts, and the cap. The cover can be configured and dimensioned to detachably interlock relative to the base. In the mated configuration, the cap and the base can form a battery opening configured and dimensioned to receive therethrough a battery.

U.S. Pat. No. 11,148,026 for System and method for monitoring performance characteristics associated with user activities involving swinging instruments by inventors Syed et al., filed Sep. 30, 2019 and issued Oct. 19, 2021, discloses various components of a system for monitoring and/or tracking a user's performance during an activity involving an instrument that is swung. Exemplary embodiments can include a sensor module configured to be secured to the instrument. The sensor module can detect a swing event and/or an impact between the instrument and an object and can implement power management features to limit or manage a power consumption of the sensor module. The sensor module can transmit swing information to an electronic device associated with the user, which can display the swing information, process the swing information, and/or transmit the swing information to a remote system.

U.S. Pat. No. 9,395,385 for Method and apparatus for determining a relative orientation of points on a rigid body by inventor Parke et al., filed Dec. 4, 2014 and issued Jul. 19, 2016, discloses an inertial measurement unit that is affixed to a rigid body. The inertial measurement includes a gyroscope that measures a first angular velocity and an angular acceleration; a first accelerometer that measures a first acceleration; a communications unit that receives a measurement signal, the measurement signal including a second acceleration transmitted from a second accelerometer, the second accelerometer being affixed to the rigid body; and a controller that calculates a relative orientation of the inertial measurement unit and the second accelerometer, and a distance separating the inertial measurement unit and the second accelerometer.

U.S. Pat. No. 8,905,856 for Method and Apparatus for determining a relative orientation of points on a rigid body by inventors Parke et al., filed Jan. 17, 2013 and issued Dec. 9, 2014, discloses an inertial measurement unit that is affixed to a rigid body. The inertial measurement includes a gyroscope that measures a first angular velocity and an angular acceleration; a first accelerometer that measures a first acceleration; a communications unit that receives a measurement signal, the measurement signal including a second acceleration transmitted from a second accelerometer, the second accelerometer being affixed to the rigid body; and a controller that calculates a relative orientation of the inertial measurement unit and the second accelerometer, and a distance separating the inertial measurement unit and the second accelerometer.

U.S. Pat. No. 8,998,717 for Device and method for reconstructing and analyzing motion of a rigid body by inventors Parke et al., filed Jan. 17, 2013 and issued Apr. 7, 2015, discloses an information processing apparatus including circuitry configured to acquire information corresponding to a reference orientation that indicates a spatial position of a sensor unit attached to a golf club. The reference orientation is determined based on a vector projecting in a normal direction from a planar surface of the golf club. The circuitry acquires a measurement signal generated by the sensor unit in response to a movement of the golf club, the measurement signal including measurements of one or more of an angular acceleration, a linear acceleration, and an angular velocity. The circuitry generates data corresponding to a motion path of the golf club based on the measurement signal and the reference orientation. The circuitry controls an interface to output the generated data corresponding to the motion path.

SUMMARY OF THE INVENTION

The present invention relates to a system and a device, attachable to a golf club, for measuring characteristics of a golf swing by a plurality of sensors, during play. The present invention implements power saving mechanisms and communication protocols that function to provide varying power levels to a plurality of sensor and computer components based on the environment of the golf club in order to extend the battery life of the device.

It is an object of this invention to provide systems and method for analyzing data associated with a user's golf swing. It is another object of this invention to provide power savings mechanisms to allow data capture device to have longer battery life. It is another object of this invention to provide a compact, lightweight device that does not interfere with a golf swing.

In one embodiment, the present invention includes a device attachable to a golf club for measuring characteristics of a golf swing comprising: an inertial measurement unit, a magnetometer, a microcontroller including a microprocessor, a photosensor, and a battery; wherein the inertial measurement unit is in communication with the magnetometer; wherein the microcontroller is in communication with the inertial measurement unit and the photosensor; wherein the device is initially in a dark state; wherein in the dark state, the battery provides power to the photosensor; wherein upon the photosensor detecting a predetermined threshold of light, the photosensor sends a communication to the microprocessor indicating the photosensor has detected the predetermined threshold of light; wherein the microprocessor instructs the device to transition from the dark state to an inactive state; wherein in the inactive state, the battery provides power to an accelerometer of the inertial measurement unit; wherein, upon the accelerometer detecting motion of the device above a predetermined threshold, the accelerometer communicates a notification regarding the motion above the predetermined threshold to the microprocessor; wherein, upon the microprocessor receiving the notification regarding the motion above the predetermined threshold, the microprocessor instructs the device to transition from the inactive state to an active state; wherein upon the accelerometer detecting an orientation of the device indicating the golf club is in a pre-swing state, the accelerometer sends a notification to the microprocessor; wherein the pre-swing state is indicated when the accelerometer detects an acceleration above a first preset threshold in a z-axis or an adjusted z-axis, and detects a total acceleration below a second preset threshold; wherein, upon the microprocessor receiving the notification from the accelerometer, the microprocessor instructs the device to transition from the active state to a data collection state; wherein in the data collection state, the battery provides power to a gyroscope of the inertial measurement unit and to the accelerometer and the magnetometer; and wherein in the data collection state, the magnetometer measures an orientation of the device, the gyroscope measures a rate of rotation of the device, and the accelerometer measures motion of the device.

In another embodiment, the present invention includes a method for measuring characteristics of a golf swing comprising: attaching a tag device to a golf club; the tag device including an inertial measurement unit, a magnetometer, a microcontroller including a microprocessor, a photosensor, and a battery; the microcontroller being in communication with the inertial measurement unit and the photosensor; the device initially being in a dark state; the battery providing power to the photosensor while in the dark state; upon the photosensor detecting a predetermined threshold of light, the photosensor sending a communication to the microprocessor indicating the photosensor has detected the predetermined threshold of light; the microprocessor sending an instruction to the device to transition from the dark state to an inactive state; the battery increasing power to an accelerometer of the inertial measurement unit while in the inactive state; upon the accelerometer detecting motion of the device above a predetermined threshold, the accelerometer communicating a notification regarding the motion above the predetermined threshold to the microprocessor; upon the microprocessor receiving the notification regarding the motion above the predetermined threshold, the microprocessor instructing the device to transition from the inactive state to an active state; upon the accelerometer detecting an orientation of the device indicating the golf club is in a pre-swing state, the accelerometer sending a notification to the microprocessor, wherein the pre-swing state is indicated when the accelerometer detects an acceleration above a first preset threshold in a z-axis or an adjusted z-axis, and detects a total acceleration below a second preset threshold; upon the microprocessor receiving the notification from the accelerometer, the microprocessor instructing the device to transition from the active state to a data collection state; the battery providing power to a gyroscope of the inertial measurement unit and providing power to the accelerometer and the magnetometer while in the data collection state; and while in the data collection state, the magnetometer measuring an orientation of the device, the gyroscope measuring a rate of rotation of the device, and the accelerometer measuring motion of the device.

In yet another embodiment, the present invention includes a device attachable to a golf club for measuring characteristics of a golf swing comprising: an inertial measurement unit, a magnetometer, a microcontroller including a microprocessor, a photosensor, and a battery; wherein the inertial measurement unit is in communication with the magnetometer; wherein the microcontroller is in communication with the inertial measurement unit and the photosensor; wherein the device is initially in a dark state; wherein upon the photosensor detecting a predetermined threshold of light, the photosensor sends a communication to the microprocessor indicating the photosensor has detected the predetermined threshold of light; wherein the microprocessor instructs the device to transition from the dark state to an inactive state; wherein, upon an accelerometer of the inertial measurement unit detecting motion of the device above a predetermined threshold, the accelerometer communicates a notification regarding the motion above the predetermined threshold to the microprocessor; wherein, upon the microprocessor receiving the notification regarding the motion above the predetermined threshold, the microprocessor instructs the device to transition from the inactive state to an active state; wherein upon the accelerometer detecting an orientation of the device indicating the golf club is in a pre-swing state, the accelerometer sends a notification to the microprocessor; wherein, upon the microprocessor receiving the notification from the accelerometer, the microprocessor instructs the device to transition from the active state to a data collection state; wherein in the data collection state, the magnetometer measures an orientation of the device, a gyroscope of the inertial measurement unit measures a rate of rotation of the device, and the accelerometer measures motion of the device; wherein the microcontroller includes at least one communication unit, operable to communicate wirelessly according to a BLUETOOTH LOW-ENERGY (BLE) protocol with at least one user device; and wherein messages transmitted to the at least one user device by the at least one communication unit include sensor data from the magnetometer, the accelerometer, the photosensor and/or the gyroscope to at least one user device in real time.

These and other aspects of the present invention will become apparent to those skilled in the art after a reading of the following description of the preferred embodiment when considered with the drawings, as they support the claimed invention.

DETAILED DESCRIPTION

Figure 1:
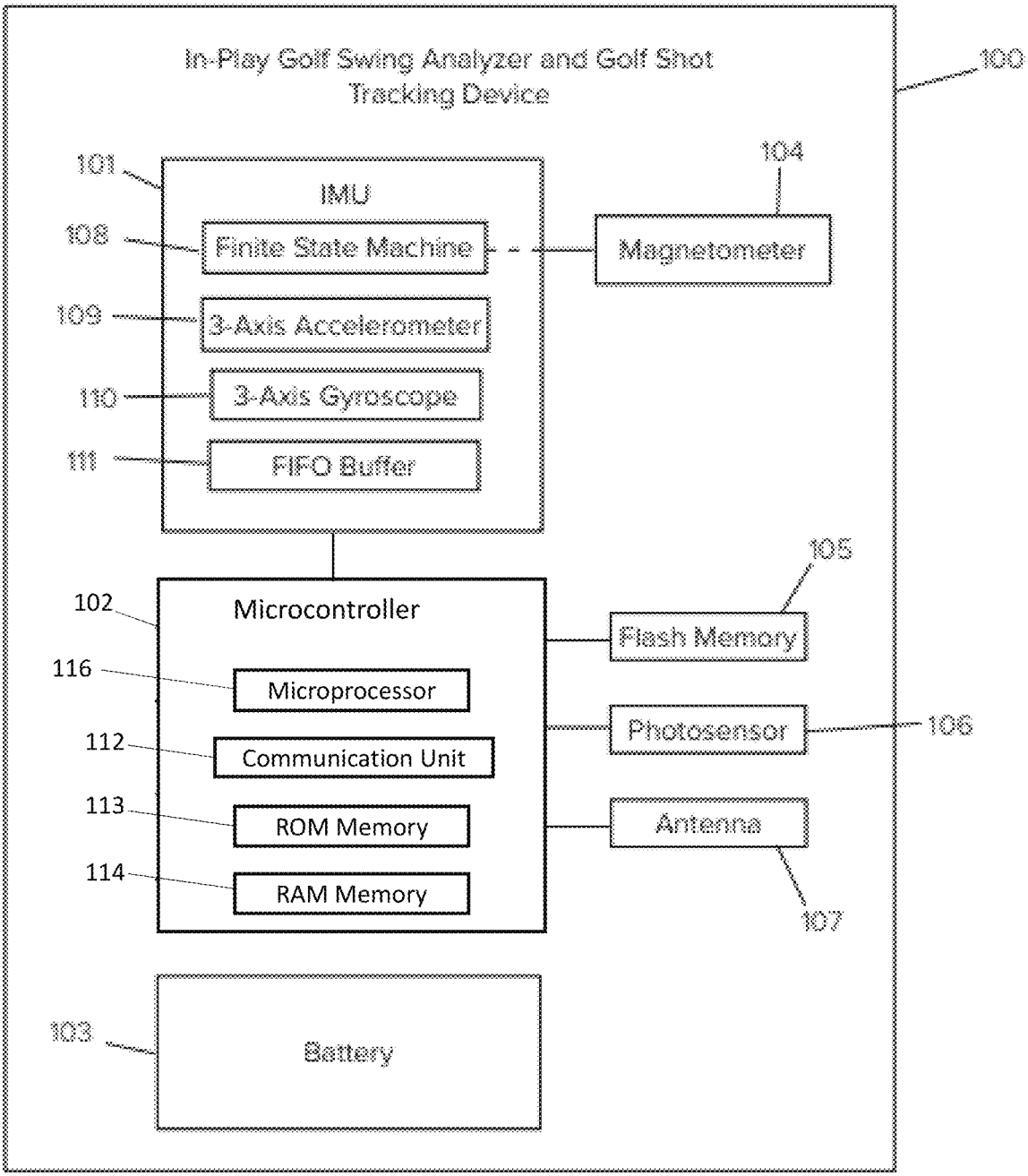
FIG. 1 illustrates a block diagram of the electronic architecture of the tag device according to one embodiment of the present invention.

The present invention is generally directed to systems and a device for analyzing golf swings through a device with a plurality of sensors that implements power saving mechanisms and communication protocols to extend battery life while maintaining a compact and lightweight size.

In one embodiment, the present invention includes a device attachable to a golf club for measuring characteristics of a golf swing comprising: an inertial measurement unit, a magnetometer, a microcontroller including a microprocessor, a photosensor, and a battery; wherein the inertial measurement unit is in communication with the magnetometer; wherein the microcontroller is in communication with the inertial measurement unit and the photosensor; wherein the device is initially in a dark state; wherein in the dark state, the battery provides power to the photosensor; wherein upon the photosensor detecting a predetermined threshold of light, the photosensor sends a communication to the microprocessor indicating the photosensor has detected the predetermined threshold of light; wherein the microprocessor instructs the device to transition from the dark state to an inactive state; wherein in the inactive state, the battery provides power to an accelerometer of the inertial measurement unit; wherein, upon the accelerometer detecting motion of the device above a predetermined threshold, the accelerometer communicates a notification regarding the motion above the predetermined threshold to the microprocessor; wherein, upon the microprocessor receiving the notification regarding the motion above the predetermined threshold, the microprocessor instructs the device to transition from the inactive state to an active state; wherein upon the accelerometer detecting an orientation of the device indicating the golf club is in a pre-swing state, the accelerometer sends a notification to the microprocessor; wherein the pre-swing state is indicated when the accelerometer detects an acceleration above a first preset threshold in a z-axis or an adjusted z-axis, and detects a total acceleration below a second preset threshold; wherein, upon the microprocessor receiving the notification from the accelerometer, the microprocessor instructs the device to transition from the active state to a data collection state; wherein in the data collection state, the battery provides power to a gyroscope of the inertial measurement unit and to the accelerometer and the magnetometer; and wherein in the data collection state, the magnetometer measures an orientation of the device, the gyroscope measures a rate of rotation of the device, and the accelerometer measures motion of the device.

In another embodiment, the present invention includes a method for measuring characteristics of a golf swing comprising: attaching a tag device to a golf club; the tag device including an inertial measurement unit, a magnetometer, a microcontroller including a microprocessor, a photosensor, and a battery; the microcontroller being in communication with the inertial measurement unit and the photosensor; the device initially being in a dark state; the battery providing power to the photosensor while in the dark state; upon the photosensor detecting a predetermined threshold of light, the photosensor sending a communication to the microprocessor indicating the photosensor has detected the predetermined threshold of light; the microprocessor sending an instruction to the device to transition from the dark state to an inactive state; the battery increasing power to an accelerometer of the inertial measurement unit while in the inactive state; upon the accelerometer detecting motion of the device above a predetermined threshold, the accelerometer communicating a notification regarding the motion above the predetermined threshold to the microprocessor; upon the microprocessor receiving the notification regarding the motion above the predetermined threshold, the microprocessor instructing the device to transition from the inactive state to an active state; upon the accelerometer detecting an orientation of the device indicating the golf club is in a pre-swing state, the accelerometer sending a notification to the microprocessor, wherein the pre-swing state is indicated when the accelerometer detects an acceleration above a first preset threshold in a z-axis or an adjusted z-axis, and detects a total acceleration below a second preset threshold; upon the microprocessor receiving the notification from the accelerometer, the microprocessor instructing the device to transition from the active state to a data collection state; the battery providing power to a gyroscope of the inertial measurement unit and providing power to the accelerometer and the magnetometer while in the data collection state; and while in the data collection state, the magnetometer measuring an orientation of the device, the gyroscope measuring a rate of rotation of the device, and the accelerometer measuring motion of the device.

In yet another embodiment, the present invention includes a device attachable to a golf club for measuring characteristics of a golf swing comprising: an inertial measurement unit, a magnetometer, a microcontroller including a microprocessor, a photosensor, and a battery; wherein the inertial measurement unit is in communication with the magnetometer; wherein the microcontroller is in communication with the inertial measurement unit and the photosensor; wherein the device is initially in a dark state; wherein upon the photosensor detecting a predetermined threshold of light, the photosensor sends a communication to the microprocessor indicating the photosensor has detected the predetermined threshold of light; wherein the microprocessor instructs the device to transition from the dark state to an inactive state; wherein, upon an accelerometer of the inertial measurement unit detecting motion of the device above a predetermined threshold, the accelerometer communicates a notification regarding the motion above the predetermined threshold to the microprocessor; wherein, upon the microprocessor receiving the notification regarding the motion above the predetermined threshold, the microprocessor instructs the device to transition from the inactive state to an active state; wherein upon the accelerometer detecting an orientation of the device indicating the golf club is in a pre-swing state, the accelerometer sends a notification to the microprocessor; wherein, upon the microprocessor receiving the notification from the accelerometer, the microprocessor instructs the device to transition from the active state to a data collection state; wherein in the data collection state, the magnetometer measures an orientation of the device, a gyroscope of the inertial measurement unit measures a rate of rotation of the device, and the accelerometer measures motion of the device; wherein the microcontroller includes at least one communication unit, operable to communicate wirelessly according to a BLUETOOTH LOW-ENERGY (BLE) protocol with at least one user device; and wherein messages transmitted to the at least one user device by the at least one communication unit include sensor data from the magnetometer, the accelerometer, the photosensor and/or the gyroscope to at least one user device in real time.

Golf is a club-and-ball sport in which players use a variety of golf clubs to strike golf balls across a golf course in an attempt to reach a series of holes on the course in as few strokes as possible. Golf is an incredibly popular game that has developed an increasingly competitive community. Golf communities and golf players pride themselves of reducing their strokes per hole, which is the center focus of the game.

Therefore, there is a wide market for devices, techniques, systems, and classes to increase ones' golfing skills and reduce their strokes per game. In order to become a more proficient golfer, golfers must understand the intricacies of their golf stroke. In order to better understand one's golf stroke, computer devices have been implemented to measure the parameters associated with one's golf swing. Devices that measure the angle, speed, acceleration, contact point, and orientation of one's golf swing are often used to analyze a golfer's performance, which is used to better one's golf play.

In golf, it is beneficial to track a golfer's shots made on the golf course during a round of play. Much more than just for purposes of scoring, knowing how far and where a golfer hits each shot, along with the club used to make each shot, helps the golfer improve his play and provides an entertaining look back at his round. In order to accomplish this, tag devices are attached to golf clubs that work in conjunction with GPS-enabled mobile devices to monitor and track a golfer's performance and shot location. This is accomplished by taking the geo-location data of each golf shot and calculating the distance between them, which can be overlayed onto a graphical representation of the golf course being played. This process is repeated until the hole is played out.

Conventional tag devices have several shortcomings, including: requiring intervention during play; producing sensor data that was based on an invalid swing (i.e., a practice swing or a miss); providing limited information about the characteristics of the golf swing; only providing information of the geo-location of each golf shot; insufficient battery life due to high power demands of the tag device; and a short life of the tag devices due to batteries not being replaceable or rechargeable.

Conventional devices also include Single-club training devices that employ sensors attached to a golf club to provide a re-creation and analysis of a golfer's swing. Illustrative of such devices are the SKYPRO® swing analyzer by SkyHawke Technologies, LLC. While these devices provide a 3-D depiction of a golfer's swing, they use conventional systems that are too expensive and impractical to attach to each golf club. Furthermore, these devices employ systems that are large, require rechargeable batteries, and high-power demands. These factors make it impractical or impossible for use on a golf course and further impractical when prior art devices are attempted to be used in connection with the plurality of golf clubs conventionally utilized during a golf game. While a golfer could move the device from one club to another during play, this would require a significant amount of intervention and would slow play, which is an important consideration in a game that takes an average of four hours to complete. More importantly, these limitations impose significant alignment issues because the device must be precisely aligned on the club and re-calibrated each time the device is moved. Due to of these limitations, devices are sold as a single unit (i.e., only one for a whole set of golf clubs) where a golfer hits multiple shots with one club before moving the device to another club and re-calibrating it.

What is needed is a sensor-based device that can practically be placed on each of a golfer's clubs to detect and record shots without needing to be removed from a club and placed on another club when a golfer switches clubs. Additionally, it would be useful for a tag device to be of a weight and form that does not interfere with the golfer's swing and provide data associated with the characteristics of the golf swing itself.

However, one problem is that such a device needs to be located on or affixed to the actual golf club in order to capture the swing data accurately, which often interferes with the golfer's swing. Another problem occurs in that tag devices consume a significant amount of power and either require larger batteries to function or do not have the battery life needed to complete a full round of golf. This is counter to the purpose of such data capture devices. Therefore, manufacturers of golf swing data capture devices must balance the needs of creating a sophisticated device with a plurality of sensors that also maintain a small and lightweight form and figure. This problem grows in complexity as golfers require more data about their golf swings while requiring less interference with their golf swings. Otherwise, the device intended to analyze one's golf swing in order to perfect it would actually interfere with one's golf swing.

There are many factors that contribute to the weight and size of a golf swing data capture device (called tag devices). Much of the size and form factor is related to the weight and size of the individual components of the device. One of the largest components required by these devices is the battery. Most golf courses consist of eighteen holes, of which at least nine are usually played at once. Accordingly, a round of golf often lasts at least several hours and therefore requires a tag device with significant charge. If a tag device runs out of battery during play, valuable data about a golfer's performance is not captured and a golfer cannot learn from their mistakes or successes on the course. This is a particularly disappointing situation if the round was notably successful (e.g., it resulted in a hole-in-one). Therefore, a long battery life is greatly desired. However, increasing the size of the battery typically comes at the cost of increasing the weight of the device, thereby affecting the golf swing more, especially if a golfer switches between a club which has a tag device adding noticeable extra weight to the device and another club. As an alternative, it is desirable to optimize the battery life of the device such that it is able to function throughout the entire eighteen-hole endeavor.

Furthermore, it is increasingly beneficial to have a tag device attached to the butt end of a golf club and to be as small and lightweight as possible. The addition of just a few grams in weight to the end of a golf club increases the swing weight by an additional 1 to 2 points, which affects the feel and performance of the golf club. This negatively affects the golfer's performance. Swing weight, shaft stiffness, and golf club profile determine how and where the golf club transitions from the backswing to the downswing, how the shaft loads, and where the golf club will bottom out during the swing. These are all factors that affect a golfer's performance, and lead to the importance of crafting a device that interferes the least with the aforementioned factors.

Therefore, what is needed is a device that can capture data associated with a golfer's swing that employs power saving mechanisms to reduce power consumption at start up and only provide power to the high-power consumption components of the device when capturing data, thereby providing a device capable of capturing swing data throughout a golf round without interfering with the golfer's swing.

The present invention solves this problem by implementing power saving mechanisms in the form of multiple power states that function to use less battery power and less processing power, which in turn extends battery life.

The present invention further solves this problem by providing swing detection and data capture functionality by a finite state machine of an inertial measurement unit as opposed to RAM or ROM of a microcontroller.

The present invention further solves this problem by implementing BLUETOOTH LOW-ENERGY (BLE) communication protocols that function to use less processing power and in turn extend battery life, in part by providing for data transmission without establishing a connection between the tag device and a computing device.

The present invention further solves this problem by including a specific configuration of the tag device's base, printed circuit board (PCB), and battery connection that allows the tag device to be smaller and lighter than competitive options. The light weight and size of the tag device has a minimal to no effect on a golfer's swing compared to prior art tag devices.

The present invention is directed to systems and methods for a device operable to analyze characteristics associated with a golf swing. The present invention is directed to a multifunctional golf swing capture and analysis device, "Supertag," or "tag device." The present invention is further directed to a device that implements a power saving mechanism that functions to reduce the processing power of the device, resulting in an extended battery life. The power saving mechanisms are operable to eliminate, reduce, or normalize processing power to a plurality of sensors and components at specific times in order to achieve the desired result of data capture while optimizing battery life. This is accomplished by limiting sensor use until the very moment the sensor is needed for data capture. This is further accomplished by implementing BLUETOOTH LOW-ENERGY (BLE) protocols that reduce the processing power needed to transmit sensor data.

In the preferred embodiment of the present invention, the device is comprised of a printed circuit board (PCB) mounted in a case attached to the end of a golf club grip, mounted within a golf club grip, or attached to the end of and mounted partially within a golf club grip. In one embodiment, the printed circuit board includes, but is not limited to, one, multiple, all, or a specific combination of the following sensors and components:

In one embodiment, the device includes an accelerometer, operable to determine acceleration along a vector in x, y, and z directions. In one embodiment, the accelerometer is a 3-axis accelerometer. In one embodiment, one, various, or all axes are utilized. In one embodiment, the accelerometer is operable at approximately 1.6 Hz. In one embodiment, the accelerometer is a 3D configurable state accelerometer operable to measure linear acceleration and/or tilt. In the preferred embodiment, the accelerometer is operable to measure the speed, acceleration, and/or tilt of the device in three axes. In one embodiment, the accelerometer is operable for activity and motion detection. In one embodiment, the accelerometer is operable for wake up, tap, and double tap logic.

In one embodiment, the accelerometer is operable to determine the device's (and in turn the golf club's) orientation for data collection. In one embodiment, the accelerometer, in conjunction of the microprocessor, is operable to determine data traditionally determined by a gyroscope. In one embodiment, an algorithm uses accelerometer data to determine the orientation of the golf club and/or the golfer's hands. In one embodiment, the algorithm is executed on the accelerometer and/or the IMU itself using the finite state machine (FSM). In one embodiment, a neural network analyzes sensor data to determine the golf club and/or the golfer's hand orientation. In one embodiment, the algorithm analysis is performed on an onboard CPU core located on the motion sensor itself.

In one embodiment, the IMU is operable to determine when a golf swing is going to occur, has occurred, and/or is occurring and thus save power by only sending sensor data to the microcontroller when a valid golf swing has been determined (i.e., not a practice swing or other golf club movement). In one embodiment, the IMU is operable to detect a golf swing using sensor data stored on the sensor itself, processing the sensor data on the sensor itself, and have the microcontroller exclusively process sensor data after a valid golf swing has been determined. In one embodiment, the microcontroller is in a low power mode prior to detecting a valid golf swing.

In one embodiment, the device includes a gyroscope, operable to determine or maintain rotational motion. In one embodiment, the gyroscope is operable to determine the degrees per second of rotation about an axis in the x, y, and/or z orientations. In one embodiment, one, various, or all axes are utilized. In one embodiment, the gyroscope is a 3-axis gyroscope. In the preferred embodiment, the gyroscope is operable to provide data regarding the location and orientation of the inertial measurement unit (IMU) of the tag device.

In one embodiment, the device includes a magnetometer and/or a digital compass, operable to determine device orientation to the earth's magnetic field. In one embodiment, the magnetometer is a monolithic integrated 3-axis magnetic sensor. In one embodiment, the magnetometer is operable to measure the strength and/or direction of magnetic fields. In the preferred embodiment, the magnetometer is operable to sense the position and/or orientation of the device in relation to the earth's magnetic field. In one embodiment, the magnetometer is operable to determine the intended bearing to target and the actual bearing to target of a golfer's swing.

In one embodiment, the device includes a light sensor, operable to detect light levels in an environment. In one embodiment, the light sensor is operable to determine wake up states for the device. In one embodiment, the light sensor is operable at a lower current draw of approximately 1 μA. In one embodiment, the light sensor is a photosensor, operable to detect a light, dark, or dim environment of the device.

In one embodiment, the device includes a microcontroller, operable to integrate data from the aforementioned components for onboard processing and/or transmission. In one embodiment, the microcontroller is operable to transmit data via BLUETOOTH LOW-ENERGY (BLE) Protocols. In one embodiment, the microcontroller is an ultra-low power system on a chip (SoC).

In one embodiment, the device includes a microprocessor, operable to receive communications from the plurality of sensors and instruct the device to transition power states. In one embodiment, the microprocessor is included in the microcontroller. In one embodiment, the microprocessor is operable to receive sensor data from the plurality of sensors. In one embodiment, the microprocessor is operable to processor the plurality of sensor data to determine the light environment, movement, acceleration, and/or orientation of the device. In one embodiment, the microprocessor is operable to determine when a predetermined threshold of light, movement, acceleration, and/or orientation is sensed by the plurality of sensors to warrant a transition from one power state to another. In one embodiment, the microprocessor is operable to instruct the IMU to transition from one power state to another. In one embodiment, the microprocessor is operable to retrieve power state instructions from the flash memory unit. In one embodiment, the microprocessor is operable to send power state instructions to the IMU. In one embodiment, the microprocessor is operable to send power state instructions to the finite state machine. In one embodiment, the microprocessor is operable to transition the device from one power state to another. In one embodiment, the microprocessor is operable to instruct the plurality of sensor to operate at a lower, higher, and/or same power level. In one embodiment, the microprocessor is operable to communicate with the battery and instruct the battery to provide a lower, higher, and/or constant power level to the plurality of sensors. In one embodiment, the microprocessor is operable to conduct the functionality of the flash memory unit.

In one embodiment, the device includes a memory unit, operable to store the microcontroller's firmware, sensor data, and identification data. In one embodiment, the memory unit includes a read-only memory (ROM) memory unit, a random-access memory (RAM) memory unit, and/or a flash memory unit.

In one embodiment, the device includes a BLUETOOTH LOW-ENERGY (BLE) radio, operable to transmit sensor data, receive data from a paired device, and/or transfer data to an interfacing device. It should be understood that while BLE is used in the preferred embodiment of the invention, other suitable RF or other communication technologies and/or protocols known in the art are also able to be utilized. In one embodiment, the BLE is operable to identify, calibrate, fingerprint, hash, and/or update tag devices, tags, and/or sensors. In one embodiment the BLE is operable to advertise at a minimum rate, an active rate, and/or an aggressive rate depending on the device's power state.

In one embodiment, the device includes a piezo sensor, operable to measure changes in pressure, acceleration, temperatures, strain, and/or force. In one embodiment, the piezo sensor is operable to convert changes in pressure, acceleration, temperature, strain, and/or force into an electrical charge. A tilt sensor, operable to detect orientation and/or inclination of the device in three axes.

In one embodiment, the device includes a battery, operable to power the sensors, components, and/or the device. In one embodiment, the battery is a lithium, ion, and/or any other suitable battery known in the art. In one embodiment, the battery is a rechargeable battery. In one embodiment, the battery is an energy harvesting circuit comprising a super capacitor, piezo, Peltier, solar cell, and/or other similar energy harvesting device known in the art. In one embodiment, the battery is a CR2032 battery. In one embodiment, the battery is a compact, high energy, lightweight battery. In one embodiment, the battery is operable at different power states.

Furthermore, each device is assigned a unique electronic serial number (ESN) or identification (ID) number, which is referred to as a fingerprint, hash, or unique identifier. In one embodiment, each individual component and/or sensor contains an ESN or ID. In one embodiment, each individual golf club contains a unique ESN or ID. In the preferred embodiment, the ESN or ID is transmitted along with the respective sensor and/or component data. In one embodiment, the ESN or ID is associated with a golf club description (e.g., drive, 9-iron). In one embodiment, the ESN or ID is on a paired device and/or written into the sensor and/or components onboard memory.

In one embodiment, the PCB, its components, and the battery are contained in a ruggedized plastic and/or composite case. In one embodiment, the ruggedized plastic and/or composite case is securely mounted to the end of a golf club grip, mounted within a golf club grip, or attached to the end of and mounted partially within a golf club grip.

In one embodiment, a mounted tag device is operable to measure and calculate various characteristics of a golfers' swing, map the location of the golf swings, visualize data associated with the golf swing, transmit and/or communicate sensor data with display, mobile, and/or interface devices, function in a plurality of power saving states, and/or utilize a plurality of communication protocols. In one embodiment, a mounted tag device is operable to determine the relative position of the golf club through GPS and/or geolocation data.

In one embodiment, the tag device is operable to determine if the golf club is position inside or outside of a golf bag. If the golf club is determined to be outside the golf bag, the tag device is operable to enter a state of waiting. The state of waiting is operable to anticipate and measure data associated with a golf swing, associate the golf swing data with a golf club ESN or ID, and conserve battery power.

More specifically, once a threshold amount of motion associated with the golf club is measured by the sensors and/or components (e.g., accelerometer, gyroscope, and/or magnetometer), the golf club is determined to be engaged in a golf swing, and the device captures various characteristics of the golf swing. In one embodiment, the device is operable to capture characteristics of a golf swing such as swing plane, swing tempo, swing velocity, swing force, swing plane, impact force, club face angle, club face orientation, club head speed, point of ball impact, swing plane, club face orientation, club head speed, point of ball impact, velocity of a golf club, a trajectory of the golf, ball, angle of impact between the golf club and the golf ball, a face angle of the golf club at impact with the golf ball, a club path during a golf swing, and/or other characteristics. In one embodiment, the swing data is stored in onboard memory and/or related via BLE to other devices via communication protocols for storage, application processing, and/or relayed to web-based systems.

In one embodiment, the tag device is paired with or in communication with a device that contains a GPS unit (e.g., SKYCADDIE). In this embodiment, the golf swing data is associated with geophysical information (e.g., time stamp, latitude, longitude, etc.). In this embodiment, the golf swing data and geophysical information is overlayed on to a golf course imagery to show the golfer in real time, and/or as a post round analysis. In this embodiment, the golf swing data and geophysical information can display the location and dynamics of the golf shot at the particular time and the particular location on a golf course.

The microcontroller's firmware is comprised of code that runs on the microcontroller to handle the microcontroller's startup, wake up, power management, sensor control, sensor data, and BLE (or similar communication protocol). The firmware is further comprised of a physics engine that analyzes the sensor date to create a 3D profile to visualize the golf swing, ball strike, and/or golf swing follow through. The sensor data and/or 3D profile is transmitted to a SkyCaddie, a GPS unit, an interfacing, a mobile, and/or a display device for logging, processing, and displaying the golf swing profile. Furthermore, the ball strike locations, ball landing locations, graphical vector data, intended bearing to target, and actual bearing to target is transmitted to the display device and overlayed onto imagery of the golf course being played to visualize the characteristics of the golf swing on the display device.

In one embodiment, the tag device is operable to time stamp golf swings. In this embodiment, the tag device, to save battery life and space, does not contain a clock unit. Instead, when the tag device transmits golf swing data to the display device, the display device automatically generates metadata including a timestamp indicating the time at which the golf swing data was received.

None of the prior art discloses a data capture device with power savings mechanisms to provide a longer battery life or use less power during use while providing accurate swing data and other related In one embodiment, the tag device can be in a dark power state, an inactive power state, an active power state, a collection power state, a streaming power state, and/or an after-swing power state. In one embodiment, the dark power state describes a power state where little to no battery power is provided to the plurality of sensors. In one embodiment, the dark power state provides battery power to the light sensors. In one embodiment, the inactive power state describes a power state where power is provided to the plurality of sensors. In one embodiment, the inactive power state only provides power to the plurality of sensors for a limited, pre-determined time based on the activity sensed by the plurality of sensors. In one embodiment, in the inactive power state, power is provided to the light sensor and low power to the accelerometer. In one embodiment, the inactive power state describes an intermediate power state that is activated when the tag device has exited the dark power state but does not have sufficient sensor parameters to enter an active power state. In one embodiment, the active power state describes a state where power is provided to the plurality of sensors and the plurality of sensors are configured to collect and measure swing data. In one embodiment, the active power state is activated where the tag device is determined to be in motion and under parameters where a swing is likely to occur. In one embodiment, the collection power state describes a state where power is provided to the plurality of sensors and the plurality of sensors are actively collecting and measuring swing data. In one embodiment, the collection power state is activated when a golf swing is occurring and a ball strike is anticipated to occur. In one embodiment, the streaming power state describes a state where power is provided to the plurality of sensors and the data collected from the plurality of sensors is being streamed to an interfacing or display device. In one embodiment, the streaming power state is activated when swing data has been collected and is being streamed to a display device. In one embodiment, the after-swing power state describes a state where power is provided to the plurality of sensors and the BLE is aggressively advertising. In one embodiment, the after-swing power state may coexist with other power states. In one embodiment, the BLE is aggressively advertising regardless of the current power state.

The plurality of power states described encompass a processing logic utilized by the tag device in order to maximize battery life. The plurality of power states functions to extend the battery life of the tag device by utilizing the plurality of sensors only to the extent need to capture swing data. Effectively, the plurality of power states are operable to activate sensor just before and/or as they are needed to collect sensor data. By limiting processing power to the plurality of sensors as much as possible, without sacrificing data collection, the tag device uses less processing power to complete its function, which allows the tag device to avoid using a large battery, which allows the tag device to remain in a small and lightweight form as to not interfere with a golf swing. The plurality of power states solves the issue presented by device that capture and measure data associated with a golfer's swing. The plurality of power states helps to balance the countervailing needs of a data capture device—functionality and accuracy of data collection vs. a small, lightweight device that does not interfere with a golf swing.

Referring now to the drawings in general, the illustrations are for the purpose of describing one or more preferred embodiments of the invention and are not intended to limit the invention thereto.

FIG. 1 illustrates a block diagram of the electronic architecture of the tag device 100 according to one embodiment of the present invention. In this embodiment, the tag device 100 includes an inertial measurement unit (IMU) 101, a microcontroller 102, a battery 103, a microprocessor 116, a magnetometer 104, a flash memory unit 105, a photosensor 106, and an antenna 107. The IMU 101 includes a finite state machine (FSM) 108, a 3-axis accelerometer 109, a 3-axis gyroscope 110, and a first in first out (FIFO) buffer unit 111. The microcontroller 102 includes a communication unit 112, RAM memory unit 113, a ROM memory unit 114, and a microprocessor 116.

The IMU 101 is a low power, high performance with an integrated 3D accelerometer 109, 3D gyroscope 110, finite state machine 108, and FIFO buffer 110. In the preferred embodiment, the IMU 101 is operable to measure the movement, speed, acceleration, and orientation of the device in three dimensions and as referenced to the earth's magnetic field. The IMU 101 is further operable for capturing, storing, and processing sensor data, then transferring the processed sensor data to a microcontroller 102 for transmission via BLE protocols.

In one embodiment, the microcontroller 102 is an ultra-low power system on a chip (SoC) microcontroller that includes communication unit 112, ROM memory 113, RAM memory 114, and the microprocessor 116. The microcontroller 102 is operable to store and execute operational instructions and processes, as well as, temporarily storing processed IMU data and transmitting the processed IMU data via BLE.

In one embodiment, the microprocessor 116 is operable to receive plurality of sensor data from a plurality of sensors. In one embodiment, the microprocessor 116 is operable to determine, based on the plurality of sensor data, when the device 100 is under conditions that warrant transitioning from one power state to another. In one embodiment, the microprocessor 116 is operable to communicate with the flash memory 105. In one embodiment, the microprocessor 116 is operable to receive power state instructions from the flash memory 105 and send the power state instructions to the IMU 101. In one embodiment, the microprocessor 116 is operable to instruct the plurality of sensors in the IMU 101 to operate at a lower, higher, consistent, and/or inactive power level. In one embodiment, the microprocessor 116 is operable to instruct the 3-axis accelerometer 109, 3-axis gyroscope 110, magnetometer 104, and/or photosensor 106 to operate at a lower, higher, consistent, and/or inactive power level. In one embodiment, the microprocessor 116 is operable to instruct the 3-axis accelerometer 109, 3-axis gyroscope 110, magnetometer 104, and/or photosensor 106 to operate in accordance with the power state instructions. In one embodiment, the microprocessor 116 is operable to instruct the 3-axis accelerometer 109, 3-axis gyroscope 110, magnetometer 104, and/or photosensor 106 to operate to transition from one power state functionality to another power state functionality. In one embodiment, the microprocessor 116 is operable to instruct the 3-axis accelerometer 109, 3-axis gyroscope 110, magnetometer 104, and/or photosensor 106 to operate according to a power state protocol. In one embodiment, the microprocessor 116 is operable to instruct the battery 103 to provide power to the 3-axis accelerometer 109, 3-axis gyroscope 110, magnetometer 104, and/or photosensor 106. In one embodiment, the microprocessor 116 is operable to instruct the IMU 101 to operate at a power state, a different power state, and/or the current power state. In one embodiment, the microprocessor 116 is operable to conduct the functionality of the flash memory 105.

In one embodiment, the microprocessor 116 is operable to determine a pre-swing state, a swing state, and/or an after-swing state of the device 100. In one embodiment, the microprocessor 116 is operable to receive a plurality of sensor data from the 3-axis accelerometer 109 to determine a pre-swing state, a swing state, and/or an after-swing state of the device 100. In one embodiment, the microprocessor 116 is operable to determine an adjusted z-axis orientation of the device 100. In one embodiment, the microprocessor 116 is operable to determine a z-axis orientation of the device 100 that indicates the device 100 is in a pre-swing, swing, and/or after-swing state. In one embodiment, the microprocessor 116 is operable to determine an adjusted z-axis orientation of the device 100 that indicates the device 100 is in a pre-swing, swing, and/or after-swing state. In one embodiment, the microprocessor 116 is operable to calibrate the device 100 to adjust for the swing orientation of a golfer. In one embodiment, the microprocessor 116 is operable to communicate with a neural network to calibrate the device 100 to adjust for the swing orientation of a golfer. In one embodiment, the microprocessor 116 is operable to process a plurality of sensor data from the 3-axis accelerometer 109 to determine when the device 100 is in a pre-swing, swing, and/or after-swing state. In one embodiment, the microprocessor 116 is operable to process a plurality of sensor data from the 3-axis accelerometer 109, adjust for the golfer's swing orientation, and determine when the device 100 is in a pre-swing, swing, and/or after-swing state.

In one embodiment, the plurality of sensor data is stored using a first in, first out que. In one embodiment, the plurality of sensor data is stored on a circular buffer.

In one embodiment, the magnetometer 104 is a monolithic integrated 3-axes device operable to measure the strength and direction of magnetic fields. In a preferred embodiment, the magnetometer 104 is operable to sense the position and orientation of the device 100 in relation to the earth's magnetic field.

In one embodiment, the flash memory unit 105 is a non-volatile, bi-directional memory medium. In the preferred embodiment, the flash memory unit 105 is operable to store specific data pertaining to the calibration and identification of the device and the operational instructions that control input and output operations, and to serve as temporary storage for captured and processed sensor data.

In one embodiment, the photosensor 106 is a photoconductive light sensor that is operable to provide input to the microcontroller 102 for the optimization and limitation of power drawn by the device 100 when located in a dark environment.

In one embodiment, the antenna 107 is a 2.4 GHz RF antenna. In one embodiment the antenna 107 is designed with components to optimize transmission quality and range of BLE data communication between a display device and other BLE enabled devices. In one embodiment, the antenna 107 is a passive channel antenna formed by a channel and backplane of the PCB. This orientation eliminates the need for a separate active antenna chip that would otherwise consume more power. In one embodiment, the antenna 107 utilizes the battery 103 negative surface for the ground plane. Furthermore, this formation provides greater range without consuming additional power that would be required by an active antenna chip. Lastly, this formation saves space on the PCB, allowing the tag device 100 to be smaller and lightweight.

In one embodiment, the finite state machine (FSM) 108 is a subcomponent of the IMU 101. The FSM 108 is operable to process data received from the accelerometer 109, the gyroscope 110, and/or the magnetometer 104 according to pre-determined logic and algorithms. The FSM 108 is further operable to transfer processed data to the FIFO Buffer 111.

In one embodiment, the 3-axis accelerometer 109 is a 3D configurable state accelerometer. The 3-axis accelerometer 109 is operable to measure linear acceleration and/or tilt. The 3-axis accelerometer 109 is further operable to measure the speed, acceleration, and/tilt of the device 100 in three axes. The 3-axis accelerometer 109 is further operable to detect activity states, motion states, wake up states, and tap/double tap logic.

In one embodiment, the 3-axis gyroscope 110 is operable to measure motion around an axis, including the angular velocity of the IMU 100 with respect to a given axis. The 3-axis gyroscope 110 is further operable to provide data regarding the location and orientation of the IMU 101.

In one embodiment, the FIFO buffer 110 is a data buffer with data compression capabilities. The FIFO buffer 110 is operable to regulate the flow of processed data to the microcontroller and to the RAM memory unit 114.

In one embodiment, the communication unit 112 is a Bluetooth transmitted operable to use Bluetooth low energy (BLE) protocols. In one embodiment, the communication unit 112 is operable for communicating with other external devices, such as display device, mobile devices, interfacing devices, and/or tablets. The communication unit 112 is further operable to send and receive signals using BLE protocols. The communication unit 112 is a transmitter operable to communicate with devices using radio waves. Bluetooth is a wireless short-range communication technology.

In one embodiment, the ROM memory unit 113 is a non-volatile, read-only memory unit. The ROM memory unit 113 is operable to store computer readable instruction to be executed by the microcontroller 102. The ROM memory unit 113 is further operable to execute input/output tasks and firmware startup, initialization, and basic operations.

In one embodiment, the RAM memory unit 114 is a bi-directional random access memory unit. The RAM memory unit 114 is operable to temporarily store processed data from the IMU 101 prior to its output from the device via communication unit 112. The RAM memory unit 114 is further operable to temporarily store data received via BLE communication 112 input until processed and distributed by the microcontroller 102.

In one embodiment, the ROM memory unit 113 exclusively contains root instructions for the tag device's startup while the flash memory unit 105 contains operational instructions and power state instructions. In this embodiment, the microcontroller 102 uses less power because the operational instructions and power state instructions are run on the flash memory 105 rather than in a microcontroller 102 environment. In one embodiment, the microprocessor 116 uses less power because the operational and power state instructions are stored on the flash memory 105. This functions to overall reduce the use of the microcontroller, which saves battery power. Furthermore, in this embodiment, the operating instructions are able to be updated by uploading new instructions to the flash memory unit 105, which does not require powering the microcontroller 102.

In one embodiment, the plurality of sensor data is processed by the IMU 101, while the microcontroller 102 manages the communication unit 112 operations. In this embodiment, battery power is saved by reducing the amount of processing power needed by the microcontroller. In order to accomplish the above stated embodiment, the IMU 101 utilizes a finite state machine 108 to process the sensor data.

In one embodiment, the plurality of sensor data is processed by the microprocessor 116. In one embodiment, the IMU 101, the 3-axis accelerometer 109, the 3-axis gyroscope 110, the magnetometer 104, the photosensor 106, and the flash memory 105 are in communication with the microprocessor 116. In one embodiment, the microprocessor 116 is operable to send power state instructions and/or protocols from the flash memory 105 to the IMU 101, the 3-axis accelerometer 109, the 3-axis gyroscope 110, the magnetometer 104, and/or the photosensor 106. In one embodiment, the microprocessor 116 is operable to receive power state instructions from the flash memory 105 in response to receiving a predetermined threshold of sensor data from the IMU 101, the 3-axis accelerometer 109, the 3-axis gyroscope 110, the magnetometer 104, and/or the photosensor 106.

Figure 2:
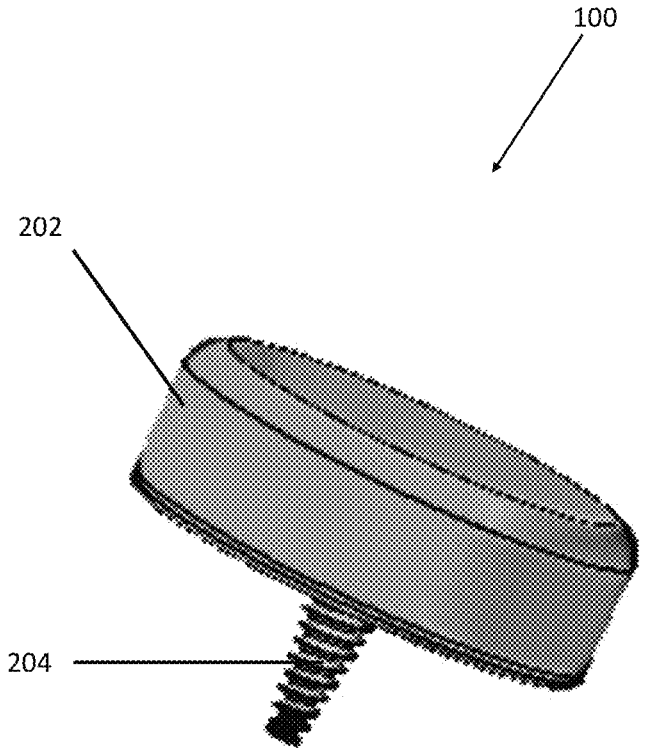
FIG. 2 illustrates a side perspective view of a tag device according to one embodiment of the present invention.

FIG. 2 illustrates a side perspective view of a tag device 100 according to one embodiment of the present invention. In one embodiment, the tag device 100 includes a printed circuit board (not shown), a mounting case 202, and a mounting mechanism 204. In one embodiment, the accelerometer, gyroscope, magnetometer/digital compass, light sensor/photosensor, microcontroller, memory unit, BLE, Piezo sensor, tilt sensor, and battery are contained within the case 202. In one embodiment, the case 202 is a ruggedized plastic and/or composite case. In one embodiment, the mounting mechanism 204 is a threaded, cone shaped screw extending outwardly from a wide base of the case 202, and has a threaded tip on the opposite end similar to a conventional screw. This allows the tag device to be screwed into the top of a golf club handle or butt end of the grip as a means of attachment.

Figure 3:
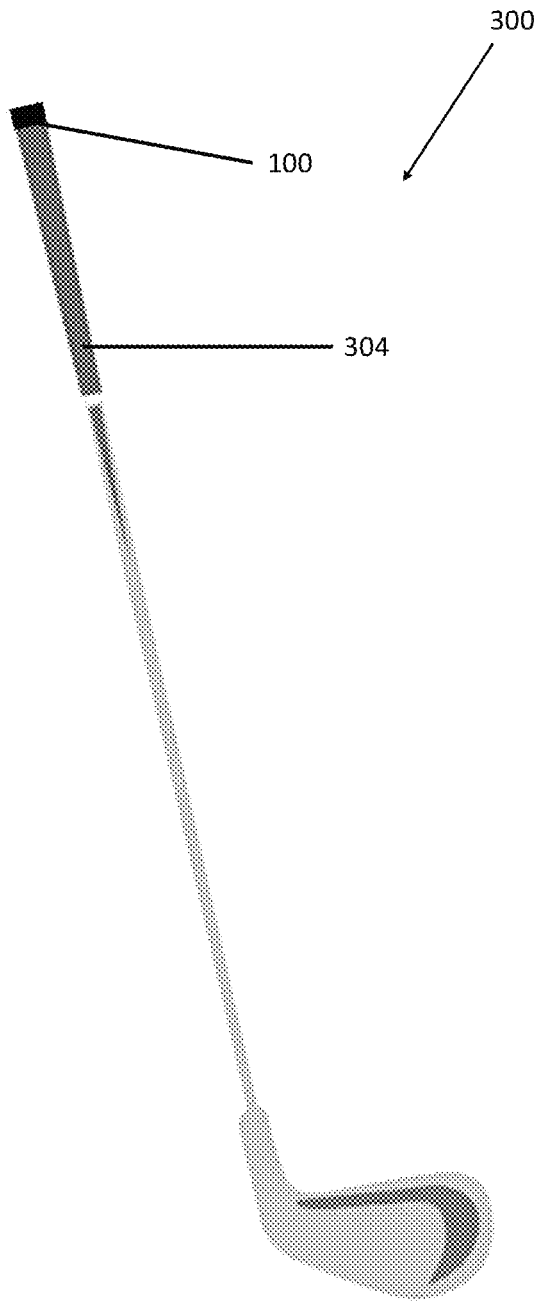
FIG. 3 illustrates a side perspective view of a tag device placement on a golf club according to one embodiment of the present invention.

FIG. 3 illustrates a side perspective view of a tag device 100 placed on a golf club 300 according to one embodiment of the present invention. In one embodiment, the tag device 100 is mounted to the top of a golf club handle 304. This allows the tag device 100 to capture data associated with a golfer's swing while allowing the golfer to swing without interference by the device. Furthermore, when the tag device 100 is mounted to a golf club 300 it is operable to determine its position in or out of a golf club bag. This is accomplished by the light sensor or photosensor's detection of a dark or light environment. As an example, when a golf club is not in use and placed in a golf bag, normally, the golf club handle is placed downward into the dark environment of the golf club bag. Conversely, when a golf club is taken out of the golf club bag and used the handle to the golf club is exposed to the light environment. Therefore, due to the tag device's 100 position on the golf club 300 the tag device is able to determine whether the golf club is in or out of the golf club bag based on the light intensity and/or the change in light intensity detected by the light sensor.

Figure 4A:
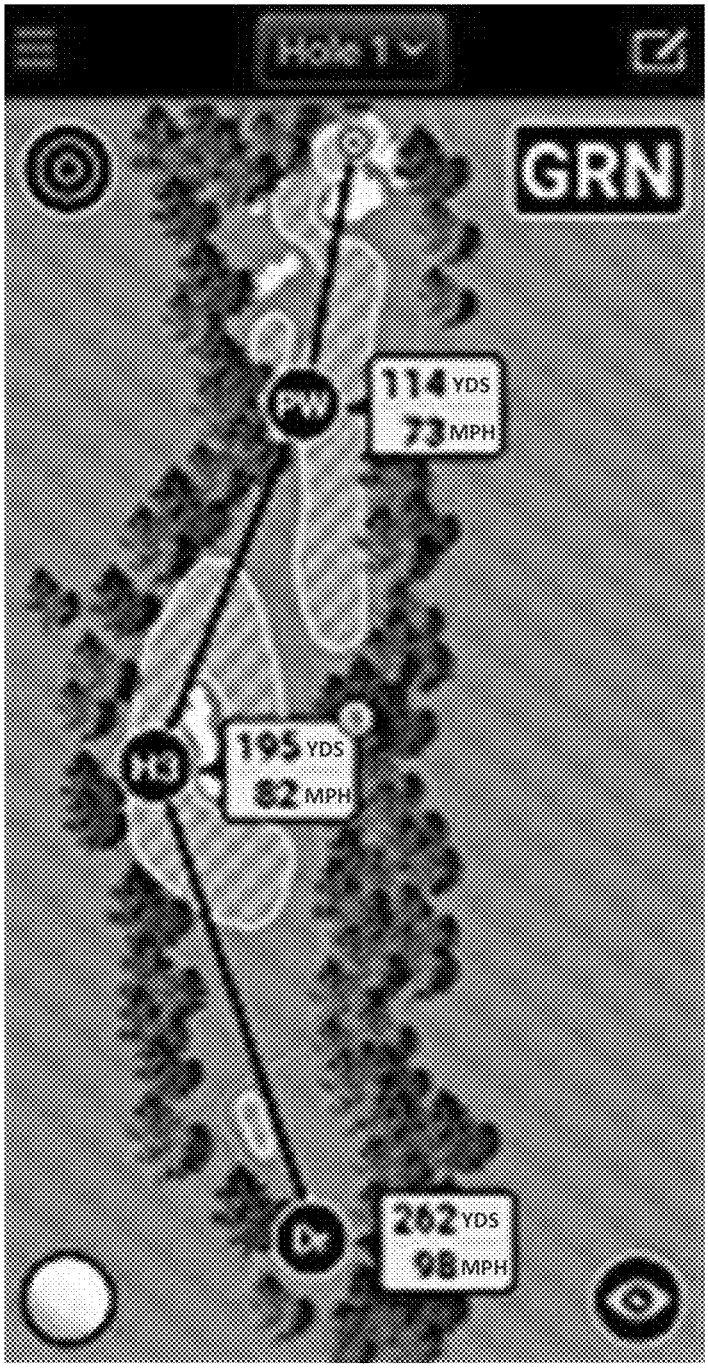
FIG. 4A illustrates an exemplary embodiment of a digital display showing the tag device's geo-location data according to one embodiment of the present invention.

FIG. 4A illustrates an exemplary embodiment of a digital display showing geo-location data according to one embodiment of the present invention. In one embodiment, the geo-location of the golf ball when struck is captured, along with other associated sensor data of the golf swing. After the golfer moves to the landing location of the golf ball, and subsequent strikes the golf ball, the geo-location is captured again. Continuing this process allows the tag device to map out the location of each golf swing as visualized in FIG. 4. Furthermore, by calculating the distance between golf swings, the tag device determines the distance traveled by the golf ball, the angle of the golf swing, and location of the golf ball on the golf course of each subsequent golf swing. In one embodiment, the tag device overlays the geo-location onto a map of the golf course being played. In one embodiment, the display device visualizes other sensor data associated with each golf swing, such as yards traveled and velocity of the golf ball as illustrated in FIG. 4.

Figure 4B:
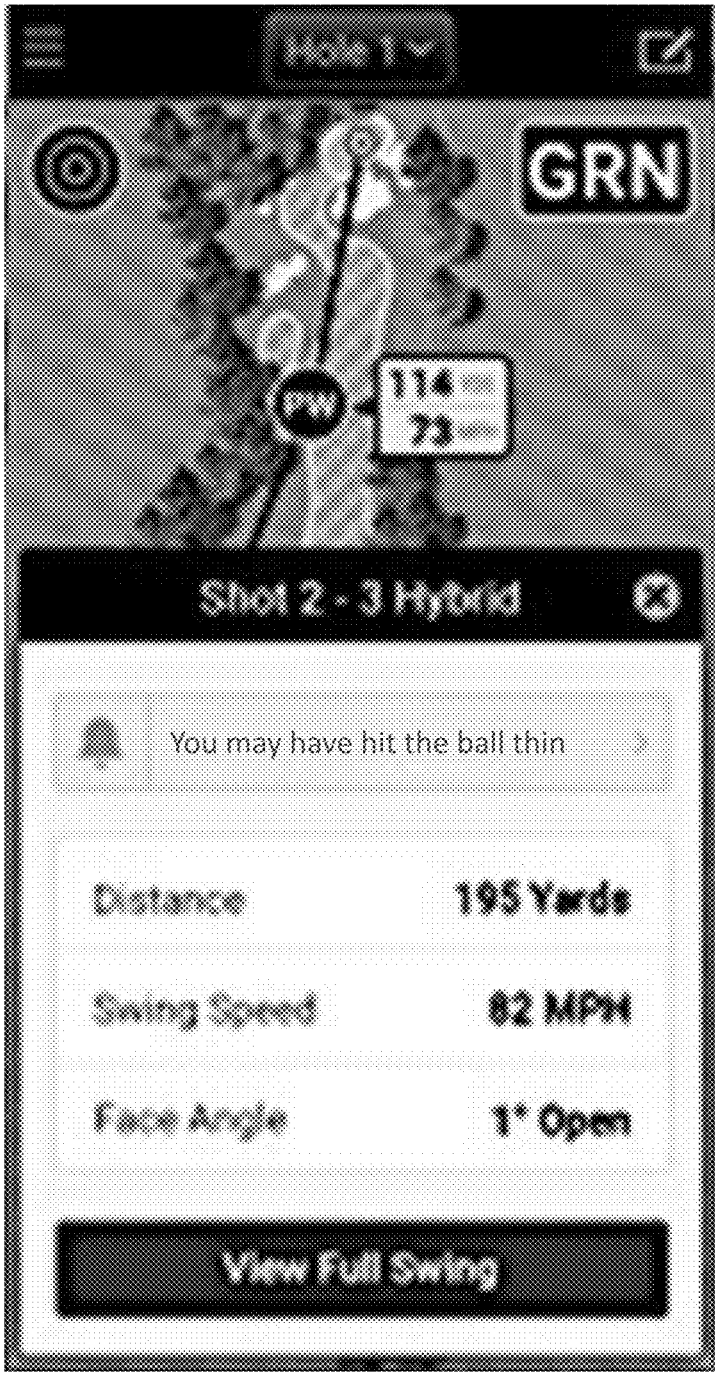
FIG. 4B illustrates an exemplary embodiment of a digital display showing the tag device's geo-location data and sensor data.

FIG. 4B illustrates an exemplary embodiment of a digital display showing tag device geo-location data and sensor data. In one embodiment, a user may select an individual golf swing to pull up an additional display that shows other sensor data (e.g., distance traveled, velocity, face angle, etc.).

In one embodiment, the tag device is operable to determine what golf course the golfer is currently playing on and the relative position of the golfer on the golf course (e.g., which hole the golfer is playing) by communicating with at least one GPS-enabled user device. In this embodiment, the determination of the golf course and position is used to overlay the plurality of sensor data onto a virtually rendered map of the golf course (or hole of the golf course) such that a user has a reference point of where each stroke occurs relative to the environment.

Figure 5:
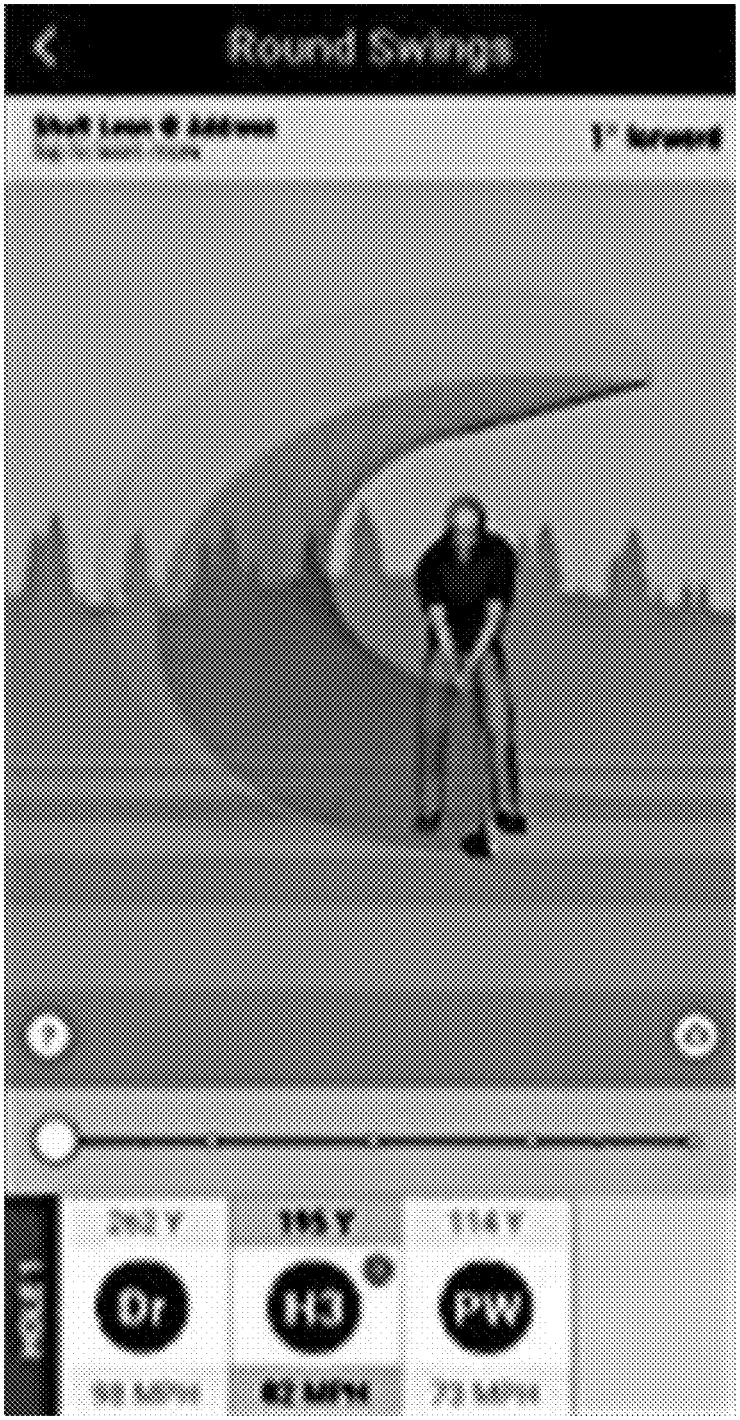
FIG. 5 illustrates an exemplary embodiment of a digital display showing swing analysis according to one embodiment of the present invention.

FIG. 5 illustrates an exemplary embodiment of a digital display showing swing analysis according to one embodiment of the present invention. In one embodiment, the tag device includes a physics engine that analyzes sensor data to create a 3D profile of a golf swing, ball strike, and golf swing follow through. This data is transmitted to a GPS-enabled device and/or other display device for logging, processing, and display of the golf swing profile as illustrated in FIG. 5.

Figure 6:
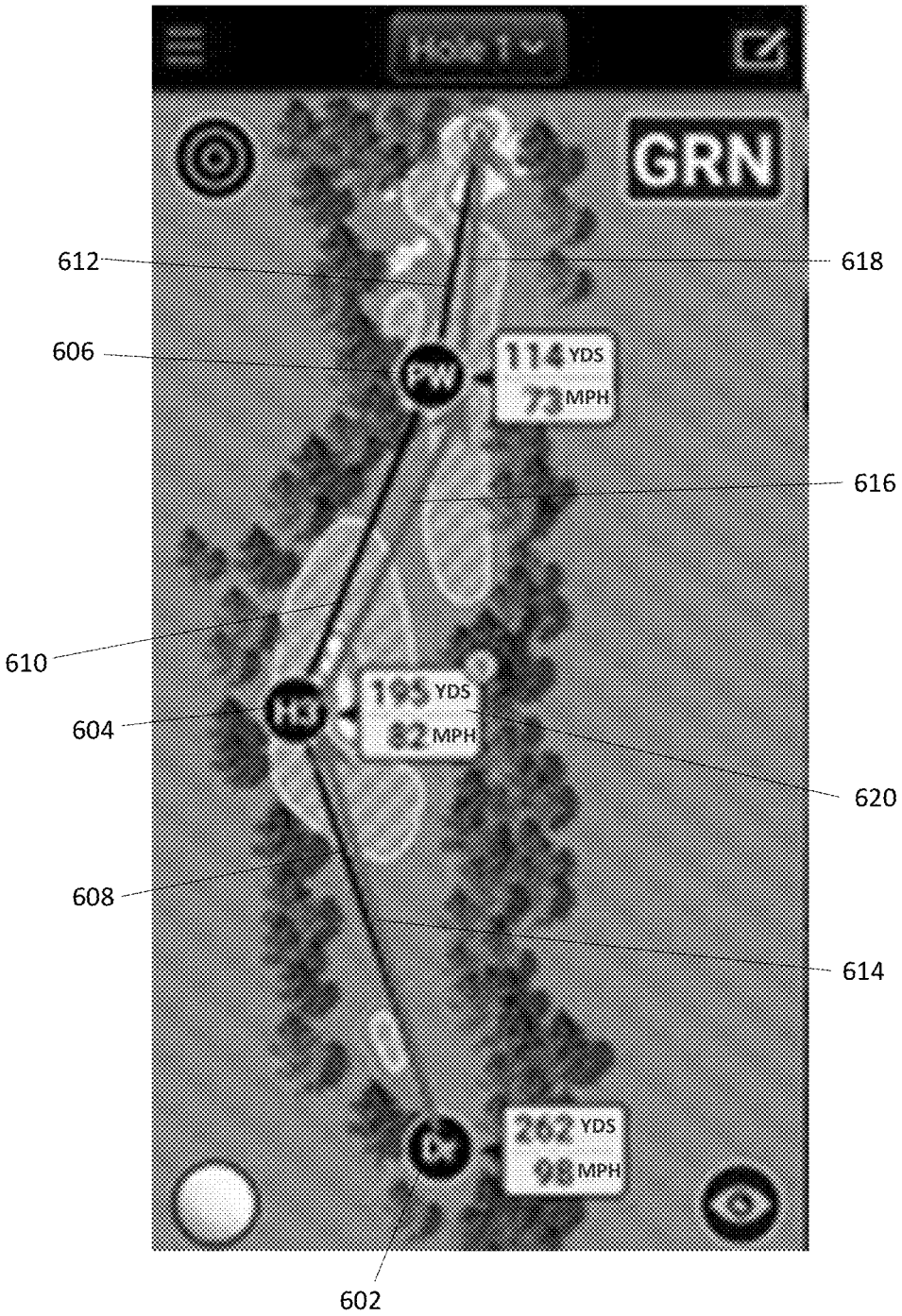
FIG. 6 illustrates an exemplary embodiment of a digital display showing the intended bearing to target compared to the actual bearing to target according to one embodiment of the present invention.

FIG. 6 illustrates an exemplary embodiment of how the intended and actual bearing to target data are visualized to a user. The user is able to visualize the golf ball's starting position 602, the golf ball's subsequent landing positions 604 and 606, the intended bearing lines 614, 616, and 618, and the actual bearing lines 608, 610, and 612 along with other associated sensor data 620. This allows the golfer to analyze and visualize the characteristics associated which each golf swing in one cohesive location.

FIG. 6 illustrates an exemplary embodiment of a digital display showing the intended bearing to target compared to the actual bearing to target according to one embodiment of the present invention. In one embodiment, the tag device is operable to determine the intended and actual bearing to target via a function applied to magnetometer sensor data. The intended bearing to target is determined by sensor data from the magnetometer and gyroscope when the golf club is pointed towards its intended target prior to, during, and after a golf swing. More specifically, the golf club's magnetic position in relation to magnetic north is captured and recorded prior to, during, and after the golf swing. In addition, in order to provide accurate swing orientation measurements during a golf swing, the magnetometer in the tag device accounts for the orientation of the club by calibrating based on data produced by the accelerometer and/or the gyroscope. The actual bearing to target is determined by implementing the geo-location of the golf ball's starting position and landing position with the sensor data from the magnetometer and gyroscope. In one embodiment, the tag device is operable to determine each shot's offset relative to the target location by using the magnetometer to locate the aim line of the golf club club's face. In one embodiment, the tag device is operable to determine the shot trajectories offset relative to the aim of the golfer by comparing the clubface angle at impact to the clubface aim line.

In one embodiment, the tag device is operable to determine the intended aim direction and the actual shot trajectory relative to the target location. In this embodiment, the tag device determines the intended aim direction and the actual shot trajectory via a function associated with magnetometer and/or digital compass sensor data. In this embodiment, the intended aim direction relative to the target location is determined by the direction the golf club is pointed prior to and/or during a golf swing. Specifically, the golf club's magnetic direction in relation to magnetic north is captured and recorded in memory prior to the golf swing. In this embodiment the accelerometer and/or gyroscope data compensates the orientation of the magnetometer to provide accurate magnetic compass degrees associated with the intended aim direction. Furthermore, the geo-location of the ball strike is captured along with any other associated sensor data of the golf swing. Additionally, upon the next swing, the golf ball's location is marked and geo-tagged. This allows the tag device to determine the actual offset of the previous swing relative to the target location, the distance the golf ball traveled, and other information associated with the golf swing.

In one embodiment, both the intended aim direction and the actual shot trajectory relative to the target location are overlayed on golf course imagery on a display device. Furthermore, true north data via declination offset tables and/or algorithms along with the vector of the golf ball flight path and landing is displayed either in real time or through post round analysis in relation to the intended aim direction. This allows a user to visualize their intended bearing and their actual bearing to target on the golf course they are playing on. Furthermore, this allows a user to identify accuracy issues in their golf swing and in the ball's flight.

In one embodiment, the intended bearings to target is determined by a calibration of the magnetometer using a 3×3 matrix and a 3×1 vector. The 3×3 matrix is a combination of a scale factor for each axis, a rotation, and a cross axis sensitive. The 3×1 vector is a measurement of the vector for each axis (i.e., the x axis, y axis, and z axis). In this embodiment, the 3×1 vector is added to each sample to represent the bias of magnetometer (i.e., one for each of the three aces measured by the magnetometer). The 3×3 matrix is then multiplied by the 3×1 sample with the 3×1 vector bias removed to determine a calibration sample for the intended bearings to target.

In one embodiment, the intended aim direction, relative to the target location, is determined from measurements from the magnetometer and measurements from the gyroscope during the golf swing to create a calibration of the magnetometer per swing. Implementation of the gyroscope to calibrate the magnetometer allows that calibration process to occur in a very short motion (i.e., the very beginning of the golf swing) rather than requiring a full swing profile. This process allows the tag device to withhold providing processing power to the gyroscope right up to the moment its sensor data is needed, in turn saving battery power.

In one embodiment, once the magnetometer is calibrated according to the above embodiments, it is further operable to use the position and angle of the golf club's face, as measured by the accelerometer and gyroscope, to compare to the position and angle of the magnetometer heading, which indicates the intended direction of the golf shot (i.e., the intended bearings to target). Furthermore, historical magnetometer and/or gyroscope data is factored into the system's calculation of the intended aim direction for fine tuning. As an example, if a golfer has the club face square to the intended target line while other golfers have the club face slightly more open, then the system adjusts the relationship between club face angle and the intended aim direction.

In one embodiment, the tag device is operable to determine the orientation of the golf club's face when in a hitting position based exclusively on accelerometer data. In this embodiment, the tag device saves power because the accelerometer draws much less power from the battery than the gyroscope. In this embodiment, the tag device is operable to analyze a ratio of acceleration along a z-axis relative to the y axis from the accelerometer to determine if the golf club is just simply being dragged around prior to getting ready for a golf swing (indicating an inactive state), being gripped in anticipation of a golf swing (indicating an active state), or being held above the head right as a golf swing is about to occur (indicating a data collection state). In this embodiment the gyroscope is only provided power during the collection, after-swing, and streaming states. This allows the tag device to avoid using the gyroscope for as long as possible, which reduces processing power used by the tag device and extending its batter life.

Figure 7:
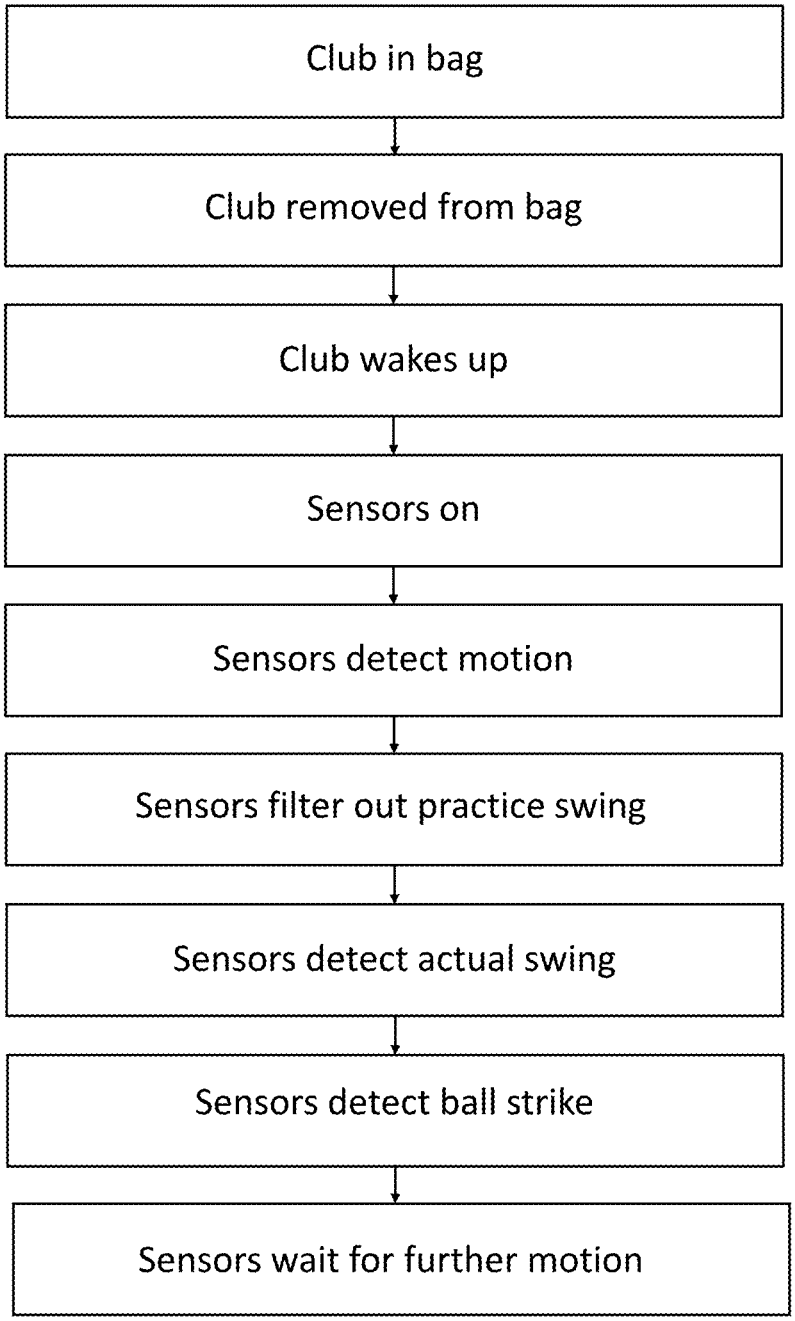
FIG. 7 illustrates a flowchart of the sensors' logic when the tag device is used according to one embodiment of the present invention.

FIG. 7 illustrates a flowchart of the sensors' logic when the tag device is used according to one embodiment of the present invention. In one embodiment, a golf club is stored in a golf bag, which is determined by the light sensors sensing a dark environment. In one embodiment, when the golf club is removed from the golf bag and the light sensors sense a light environment, the plurality of sensors activates and data collection is enabled. In one embodiment, the golf club is removed from the golf bag, and light is sensed, the accelerometer is activated to sense motion. The accelerometer is operable to detect motion and filter out practice swings by processing data from the magnetometer and gyroscope. The sensors are further operable to detect conditions that constitute an actual swing and subsequent golf ball strike. The sensors capture data associated with the golf swing. Following a golf swing, the sensors wait for further motion indicating a subsequent swing.

Figure 8:
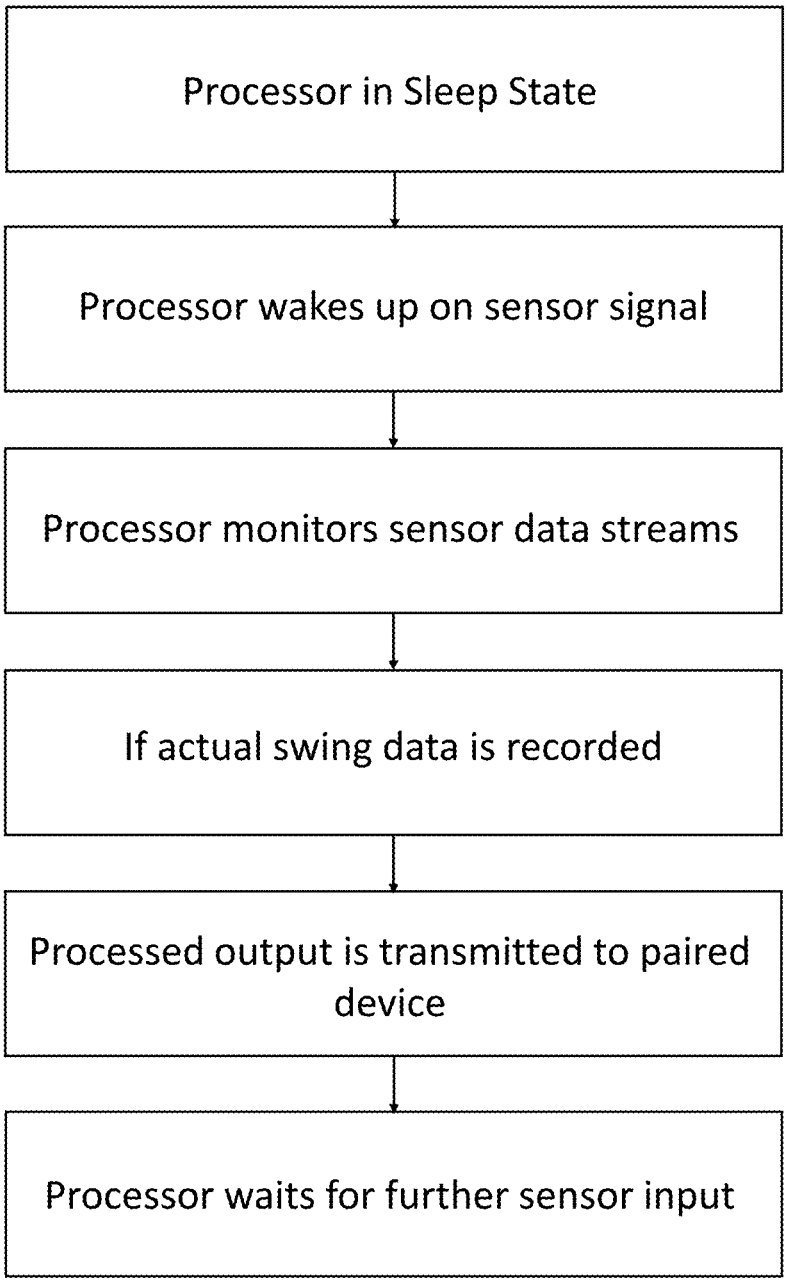
FIG. 8 illustrates a flowchart of the processor's logic when the tag device is used according to one embodiment of the present invention.

FIG. 8 illustrates a flowchart of the processor's logic when the tag device is used according to one embodiment of the present invention. In one embodiment, when the device is not in use, the processor is in a sleep state. The processor enters a wake state upon receiving sensor signal (e.g., a light environment is detected). The processor then monitors sensor data streams. When an actual swing is recorded, the processor transmits sensor data via BLE to a displayed device. The processor then awaits further sensor output.

Figure 9:
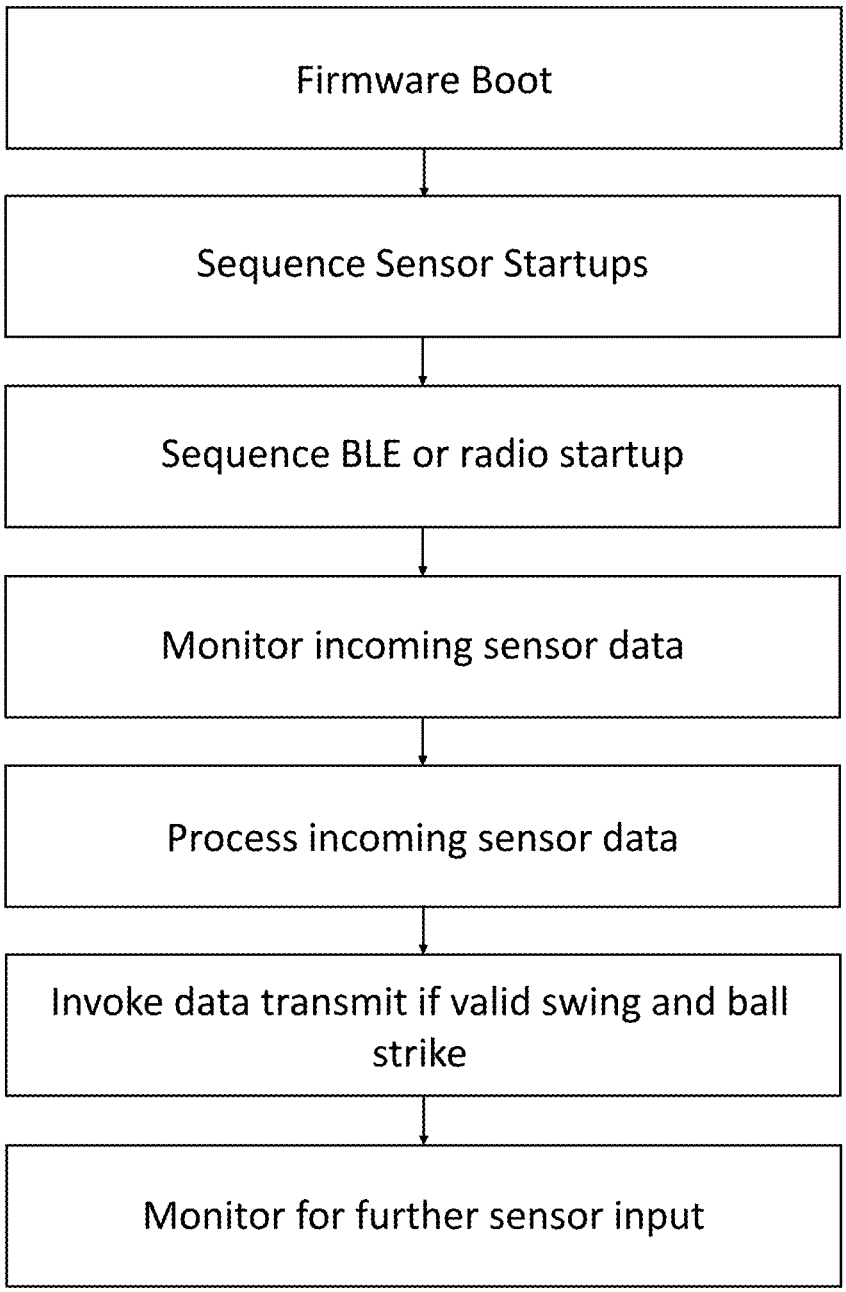
FIG. 9 illustrates a flowchart of the firmware according to one embodiment of the present invention.

FIG. 9 illustrates a flowchart of the firmware according to one embodiment of the present invention. In one embodiment, the firmware is booted-up and subsequently the plurality of sensors and computer components are booted-up. Incoming sensor data is monitored and any incoming sensor data is processed. Following a valid swing and ball strike, the data is transmitted to the display device. The firmware then monitors for further sensor input.

Figure 10:
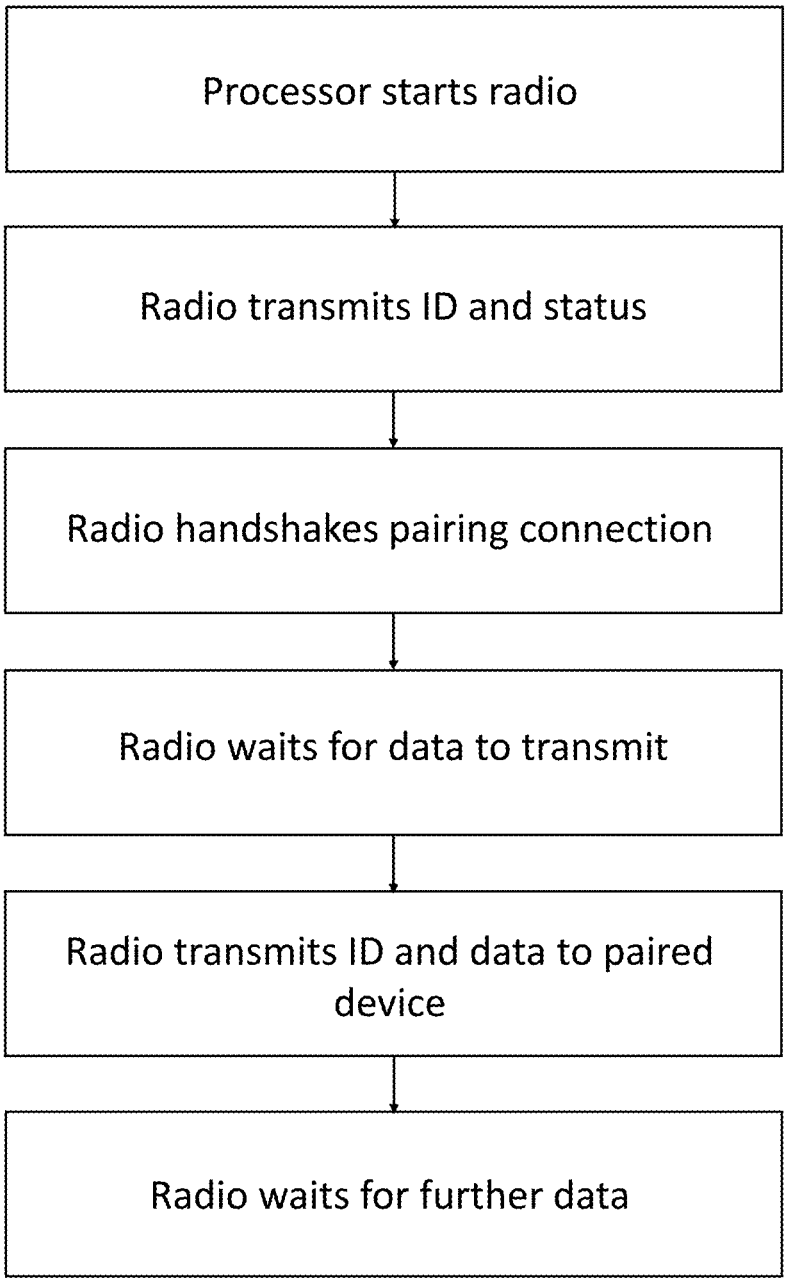
FIG. 10 illustrates a flowchart of the BLUETOOTH LOW ENERGY (BLE) and radio communication according to one embodiment of the present invention.

FIG. 10 illustrates a flowchart of the BLE communication according to one embodiment of the present invention. In one embodiment, the processor starts the BLE radio, which then transmits an ESN or ID and status to a mobile and/or display device. In one embodiment, the BLE and radio handshakes to pair the display device and the tag device and then awaits data transmission. The BLE radio transmits the ESN or ID to the display device, and then the BLE and radio waits for further data.

Figure 11:
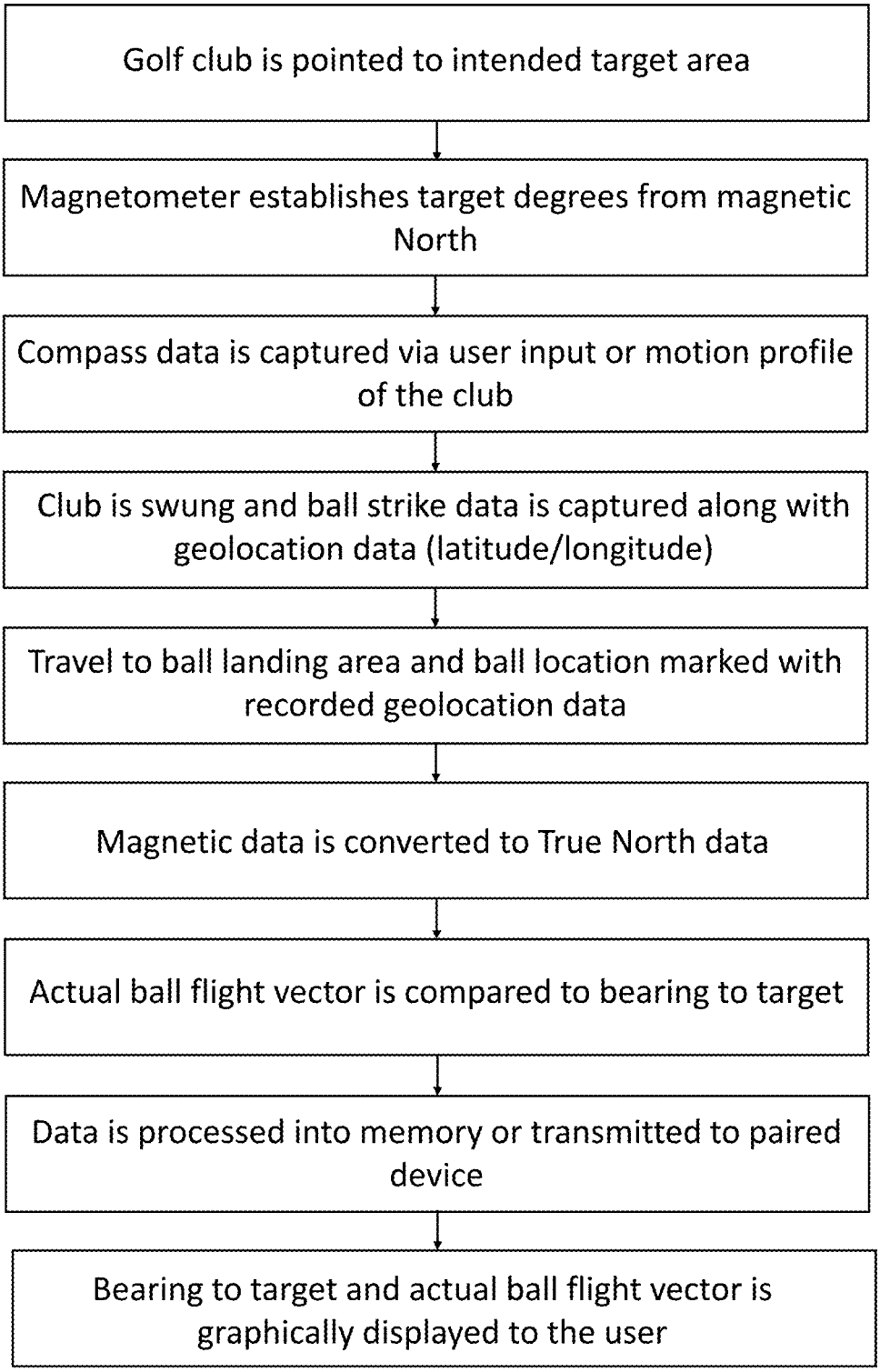
FIG. 11 illustrates a flowchart of the comparison of intended bearings to target compared to the actual bearing to target according to one embodiment of the present invention.

FIG. 11 illustrates a flowchart of the comparison of intended bearings to target compared to the actual bearing to target according to one embodiment of the present invention. In one embodiment, when the golf club is pointed to the intended target area, the magnetometer establishes the target position in relation to magnetic north by calculating a difference, in latitudinal/longitudinal degrees, between the intended aim direction (the direction the golf club is pointing towards) and magnetic north. Compass data is captured via user input and/or via motion profile of the golf club. When the golf club is swung, the ball strike data is captured and transmitted to the display device, where it is associated with geolocation metadata generated by the GPS unit of the display device. The distance between the golf ball's landing area and initial location are marked and recorded with geolocation data. The actual golf ball flight vector is compared to the intended bearing to target vector. Data is processed into memory or transmitted to a display device, and the intended aim direction and actual ball flight vector is graphically displayed to the user.

In one embodiment, the tag device is operable to extend its battery life by functioning in a plurality of power states. The plurality of power states describes computer protocols for running the plurality of sensors and/or computer components at various power levels (or not power at all). In one embodiment, the flash memory unit 105 contains the instructions to run the computer protocols that activate the plurality of power states and sends the instructions to the finite state machine 108. In one embodiment, the microprocessor 116 sends the power state instructions from the flash memory 105 to the IMU 101, the 3-axis accelerometer 109, the 3-axis gyroscope 110, the magnetometer 104, and/or the photosensor 106. In one embodiment, the microprocessor 116 is operable to receive the plurality of sensor data from the IMU 101, the 3-axis accelerometer 109, the 3-axis gyroscope 110, the magnetometer 104, and/or the photosensor 106 an determine when and/or if a predetermined threshold, indicating a power state transition, is present. The finite state machine 108 is operable to run the computer protocols and/or power state instructions. The finite state machine 108, using the computer protocols and/or power state instructions from the flash memory unit 108, is operable to run the plurality of sensors at the various power levels. Thereafter, the finite state machine 108, is operable to requests new computer protocols from the flash memory unit 105, when conditions (from the plurality of sensors) are such that a new power state should be activated. In one embodiment, the microprocessor 116 is operable to requests new computer protocols from the flash memory unit 105, when conditions (from the plurality of sensors) are such that a new power state should be activated. In one embodiment, the finite state machine 108 is operable to work in conjunction with the flash memory unit 105 and microprocessor 116 to operate the device 100 in a plurality of power states as described below. The plurality of power states are configured to optimize the amount of power drawn by the plurality of sensors so that data collection is not interfered and battery life is extended.

Figure 12:
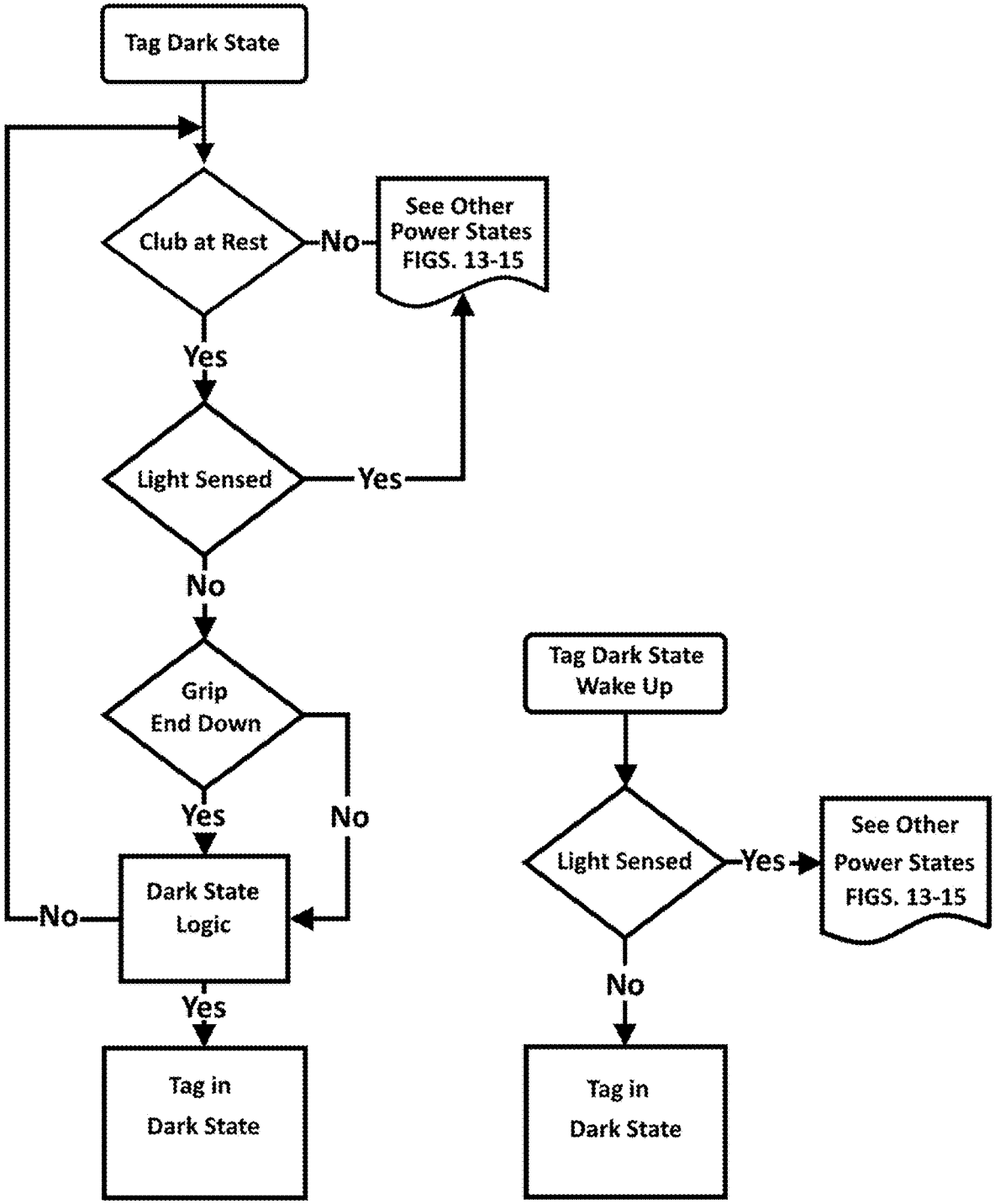
FIG. 12 illustrates a flowchart of the power state logic for a tag dark state power mode according to one embodiment of the present invention.

FIG. 12 illustrates a flowchart of the power state logic for dark state power mode according to one embodiment of the present invention. The dark state power mode represents the power state configured to conserve the most energy and extend the battery life of the tag device to the greatest degree possible. The dark state represents the common situation where a golf club is not in use and not capturing swing data. In one embodiment, the tag device operates at a dark state, which functions to use minimal battery power and only powers the light sensor at a minimum threshold. In one embodiment, the dark state therefore extends the battery life of the tag device by shutting down all but the most essential sensors and components when the golf club is at rest or in a golf bag. In one embodiment, the dark state provides minimal power to essential sensors and components. In one embodiment, sensors that detect movement, position, and/or the presence of light determine whether a dark state is initiated.

It should be understood that when describing the environment that the tag device is subject to, the golf club upon which the tag device is affixed is experiencing the same environment. In one embodiment, the tag device is operating in a dark state when the golf club is at rest, with no or little light detected, and with the handle grip oriented downwards. However, one of ordinary skill in the art will understand that dark state is also likely to be initiated when the golf club is in other dark conditions that indicate nonuse of the golf club. For example, a golf club at rest in a dark moving vehicle (e.g., the trunk of the vehicle) would also activate a dark state.

In one embodiment, the tag device exclusively provides power to the light sensor when operating in a dark state. In this embodiment, the tag device is operable to enter the inactive state only upon sensing a light environment.

In one embodiment, the tag device is operable to enter the dark state from the inactive state, active state, data collection state, after-swing state, and/or streaming state. In one embodiment, the tag device processes sensor data to determine if the golf club is at rest and not in use and therefore should enter a dark state. Conversely, if the tag device processes sensor data to determine that the golf club is in motion, ascertained by pre-determined motion thresholds, the tag device will enter an inactive state, active state, data collection state, after-swing state, and/or streaming state. If the tag device senses that the golf club is at rest, grip oriented downwards, and in a dark environment (i.e., no or low light is detected), the tag device immediately enters into a dark state power mode. In one embodiment, if the tag device does not sense a light environment (i.e., the golf club is in a dark environment like a golf bag), the tag device is operable to enter the dark state.

In one embodiment, where the tag device senses a golf club at rest, in a dark environment, and a grip orientation other than downwards, the tag device's processes sensor data and, after a pre-determined interval of not sensing a swing, enters into a dark state power mode again. In one embodiment, the tag device is configured to enter into a dark state depending on a variety of different pre-determined threshold values for the grip orientation, light environment sensed, and motion detected. One of ordinary skill in the art will understand that the tag device is able to have varying pre-determined time intervals of not sensing a swing before entering it automatically reenters the dark state power mode. In one embodiment, the tag device "wakes up" from a dark state only when an amount of light is detected by the light sensors. In one embodiment, the tag device will wake-up from a dark state only when an amount of motion is detected and/or when a certain grip orientation is detected.

In one embodiment, the light sensor operates at approximately seven nanoamps while the tag device is in the dark state. In this embodiment, the finite state machine 108 operates at a lower power to process the light sensor data. In one embodiment, the accelerometer operates at a low power state while the tag device is in the dark state. In one embodiment, the accelerometer operates at approximately 1.6 Hz while the tag device is in a dark state. In one embodiment, the tag device is operable to have a battery life of approximately 22 years if the tag device remains operating in a dark state.

Figure 13:
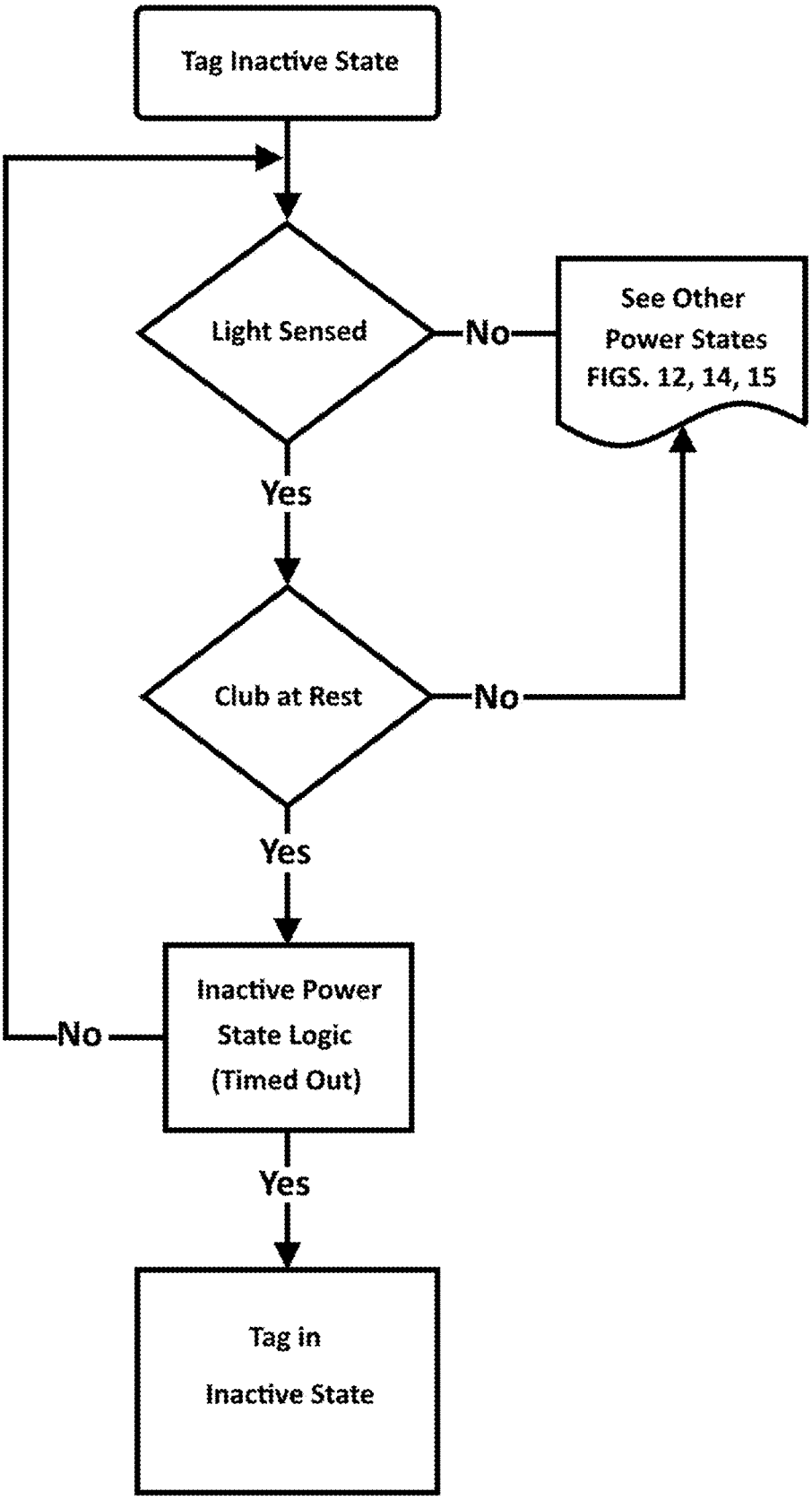
FIG. 13 illustrates a flowchart of the power state logic for a tag inactive state power mode according to one embodiment of the present invention.

FIG. 13 illustrates a flowchart of the power state logic for an inactive state power mode according to one embodiment of the present invention. In one embodiment, the inactive state is a power state that saves battery power by providing power to the light sensor and minimal power to the accelerometer. In one embodiment, the tag device will enter an inactive state after the tag device has been in an active state and stationery for a pre-determined interval of time, regardless of grip orientation. In one embodiment, the tag device enters an inactive state based on variables including low movement detection, low light detection, and/or grip orientation.

In the preferred embodiment, an inactive state is entered when the tag device detects a light environment and a golf club at rest (i.e., substantially no movement detected). In one embodiment, the tag device does not consider grip orientation data in determining whether to enter an inactive mode or not, and provides no processing power to the gyroscope while in the inactive state. In one embodiment, where the tag device is in an inactive state and light is not detected, the tag device enters a dark state and initiates the logic illustrated in FIG. 12. In one embodiment, where the tag device is initially in an inactive state, light is detected, and motion is detected, the tag device enters an active state or a data collection state. In one embodiment, where the tag device detects a light environment and a golf club at rest for a pre-defined interval, the tag device is placed in an inactive state.

In one embodiment, upon transition into the inactive state, the microprocessor 116 refreshes the finite state machine's 108 processing logic, which instructs the plurality of sensors contained in the IMU 101 to function at one of a high rate, reduced rate, and/or normal rate (i.e., provide a high, low, or normal amount of power). In one embodiment, upon transition into the inactive state, the microprocessor 116 refreshes the finite state machine's 108 processing logic to instruct the light sensor to function at a normal rate and instructs the accelerometer to function at a low rate.

In one embodiment, upon transition into the inactive state, the flash memory unit 105 refreshes the finite state machine's 108 processing logic, which instructs the plurality of sensors contained in the IMU 101 to function at one of a high rate, reduced rate, and/or normal rate (i.e., provide a high, low, or normal amount of power). In one embodiment, upon transition into the inactive state, the flash memory unit 105 refreshes the finite state machine's 108 processing logic to instruct the light sensor to function at a normal rate and instructs the accelerometer to function at a low rate.

In one embodiment, the tag device is operable to have a battery life of approximately 2 years if the tag device continuously remains in a light environment, in motion, and in an inactive power state.

Figure 14:
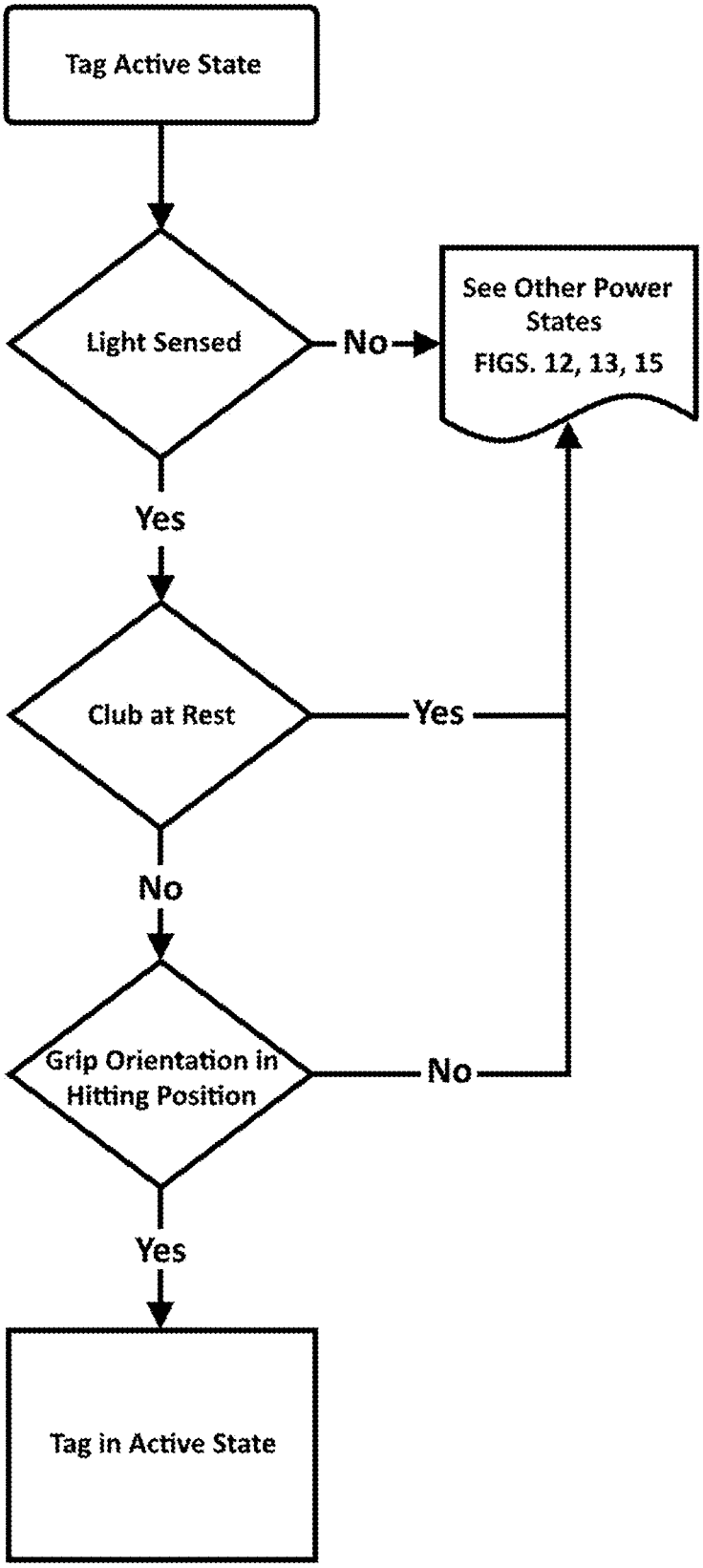
FIG. 14 illustrates a flowchart of the power state logic for a tag active state power mode according to one embodiment of the present invention.

FIG. 14 illustrates a flowchart of the power state logic for an active state power mode according to one embodiment of the present invention. An active state describes an environment where the tag device anticipates a golf swing to occur relatively soon in time. In one embodiment, the tag device is operable to provide power to the light sensor, accelerometer, and magnetometer when operating in an active state. In one embodiment, while operating in an active state, the tag device is operable to provide variable levels of power to the light sensor, accelerometer, and magnetometer. In one embodiment, the tag device will enter an active state when the golf club is in a light environment and moving, but not in a position to strike a golf ball. In one embodiment, the tag device will enter an active state when the light sensor detects a light level above a minimum threshold, golf club movement is detected, and the golf club grip is oriented upwards. In one embodiment, the tag device exits the active state and enters a different power state when a light environment is not sensed, golf club movement is not detected, and/or the golf club grip is oriented not in an upward position (i.e., a striking position).

In one embodiment, upon transition into the active state, the microprocessor 116 refreshes the finite state machine's 108 processing logic, which instructs the plurality of sensors contained in the IMU 101 to function at a high rate, reduced rate, and/or normal rate (i.e., provide a high, low, or normal amount of power). In one embodiment, upon transition into the active state, the microprocessor 116 refreshes the finite state machine's 108 processing logic to instruct the accelerometer to function at a normal and/or high rate.

In one embodiment, upon transition into the active state, the flash memory unit 105 refreshes the finite state machine's 108 processing logic, which instructs the plurality of sensors contained in the IMU 101 to function at a high rate, reduced rate, and/or normal rate (i.e., provide a high, low, or normal amount of power). In one embodiment, upon transition into the active state, the flash memory unit 105 refreshes the finite state machine's 108 processing logic to instruct the accelerometer to function at a normal and/or high rate.

In one embodiment, detection of an orientation of the tag device on the golf club by the accelerometer causes the microprocessor to instruct the tag device to transition to a data collection state. In one embodiment, the data collection state is entered when the club is relatively stable over a predetermined amount of time in a "ready to swing" position. In one embodiment, the tag device is calibrated in order to determine the ready to swing position. In one embodiment, calibration occurs by pressing a button or otherwise activating a calibration made on the tag device while in a "ready to swing" position. The tag device then determines the current vector orientation detected by the accelerometer to determine a normal pre-swing orientation of the golf club. In another embodiment, "ready to swing" orientation is determined by calibrating the tag device with a user device attached to the club face and/or the club shaft, wherein the user is prompted to stand in one or more calibration stances (e.g., ready to swing position) and/or perform one or more calibration motions (e.g., full swing, practice swing, small put, etc.). By performing the calibration step, the tag device and/or the user device saves a normal pre-swing orientation and determines an adjusted z-axis. In one embodiment, determining the adjusted z-axis includes determining x, y, and z acceleration vector components on the accelerometer in the pre-swing orientation and using vector projection to define an adjusted reference frame such that the pre-swing acceleration vector aligns with a z-axis of the adjusted reference frame. Using an adjusted z-axis, rather than the z-axis of the accelerometer is frequently necessary as golfers have different stances, where the club is often not substantially vertical when in a pre-swing position.

In one embodiment, the tag device is instructed to enter the data collection state when the acceleration along the adjusted z-axis is between approximately 0.9 and approximately 1.2 g. This allows for some tolerance of minor movements and wobble while in the pre-swing orientation. In one embodiment, the tag device is instructed to enter the data collection state when the acceleration along the adjusted z-axis is between approximately 0.9 and approximately 1.2 g and the total acceleration detected by the acceleration is below a preset threshold (e.g., about 1.25 g). Because additional acceleration is added when force is applied to the club to perform the swinging action, it is possible for acceleration along the adjusted z-axis to be within the desired range for entering the data collection state while the club is not actually still or in a downward position, but rather being swung around (e.g., in a practice swing). Therefore, filtering out total acceleration with values significantly greater than the acceleration solely along the adjusted z-axis allows the system to only enter the data collection state when the club is in a stationary, pre-swing orientation.

In another embodiment, there is increased angle tolerance for when to enter the data collection state. For example, if the accelerometer detects acceleration data indicating the club is oriented between about 20° and about −20° relative to the adjusted z-axis and the club is substantially still for a predetermined amount of time, then tag device is set to enter the data collection state. In one embodiment, in order to ensure that the club is relatively still before entering the data collection state, the tag device only enters the data collection state when the difference between two or more accelerometer readings at a predetermined sampling rate (e.g., every half second, every second, every two seconds, etc.) is below a preset threshold (e.g., 0.2 g) along a single axis. In another embodiment, in order to ensure that the club is relatively still before entering the data collection state, the tag device only enters the data collection state when the difference between two or more accelerometer readings at a predetermined sampling rate (e.g., every half second, every second, every two seconds, etc.) is below a preset threshold (e.g., 0.2 g) for the total magnitude of acceleration detected by the accelerometer.

Figure 15:
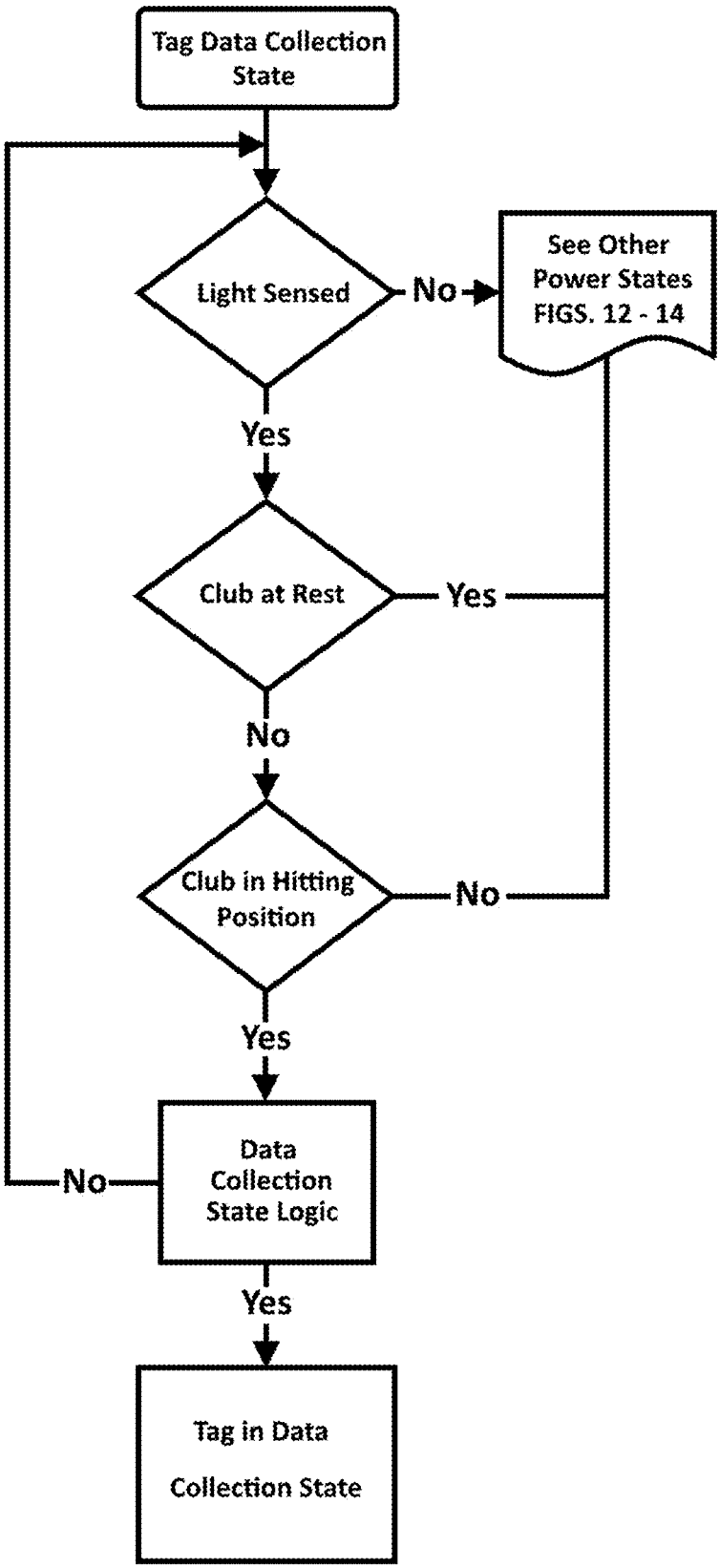
FIG. 15 illustrates a flowchart of the power state logic in a tag data collection state power mode according to one embodiment of the present invention.

FIG. 15 illustrates a flowchart of the power state logic in a data collection state according to one embodiment of the present invention. In one embodiment, the tag device is operable to provide various levels of power to the light sensor, accelerometer, magnetometer, gyroscope, and the BLE radio unit when operating in a data collection state. In one embodiment, the tag device enters a data collection state when the gyroscope detects that the club is in a predetermined orientation and exhibits a movement profile that indicates an impending swing and anticipated golf ball strike. As an example, the tag device enters a data collection state when a golf club has been reared back by the golfer just as the golfer is about to swing the club forward to contact the golf ball. The purpose of the data collection state is to activate the plurality of sensors at the last possible moment in order to both conserve battery power and collect sensor data to analyze characteristics of the golf swing.

In one embodiment, when a data collection state is entered, BLE is advertising and the accelerometer, gyroscope, and the magnetometer are powered and active in order to collect swing data. In one embodiment, the tag device enters a data collection power state when the light sensor detects a light level above a predetermined threshold, the golf club is determined not to be at rest, and the gyroscope detects the golf club in one or more predetermined orientations (i.e., above the head or behind the back). In one embodiment where a light environment is not sensed, the club is determined to be at rest, and/or the golf club is not determined to be in a hitting position, the tag device exits the data collection state and enters a different power state.

In one embodiment, upon transition into the data collection state, the microprocessor 116 refreshes the finite state machine's 108 processing logic, which instructs the plurality of sensors contained in the IMU 101 to function at a high rate, reduced rate, and/or normal rate (i.e., provide a high, low, or normal amount of power). In one embodiment, upon transition into the data collection state the microprocessor 116 refreshes the finite state machine's 108 processing logic to instruct the accelerometer to function at a normal or high rate and the gyroscope to function at a normal or high rate.

In one embodiment, upon transition into the data collection state, the flash memory unit 105 refreshes the finite state machine's 108 processing logic, which instructs the plurality of sensors contained in the IMU 101 to function at a high rate, reduced rate, and/or normal rate (i.e., provide a high, low, or normal amount of power). In one embodiment, upon transition into the data collection state the flash memory unit 105 refreshes the finite state machine's 108 processing logic to instruct the accelerometer to function at a normal or high rate and the gyroscope to function at a normal or high rate.

In one embodiment, the tag device is operable to enter the data collection state at the moment of striking a golf ball. More specifically, in the preferred embodiment of the present invention the data collection state (a high-powered state) is entered only after a golfer has reared back a golf club in anticipation of swinging the golf club forward to strike a golf ball. In one embodiment, battery life is extended because the gyroscope (a sensor requiring high power) is activated in the data collection state. In this embodiment, by reducing the amount of processing power supplied to the gyroscope, the tag device can greatly extend its battery life. In one embodiment, the battery life of the device 100 is further extended by utilizing the microprocessor 116 to refresh the operating instruction on the finite state machine 108. In one embodiment, the battery life of the tag device is further extended by utilizing the flash memory unit 105 to refresh the operating instructions on the finite state machine 108, rather than running operational instructions on the microcontroller 102.

Figure 16:
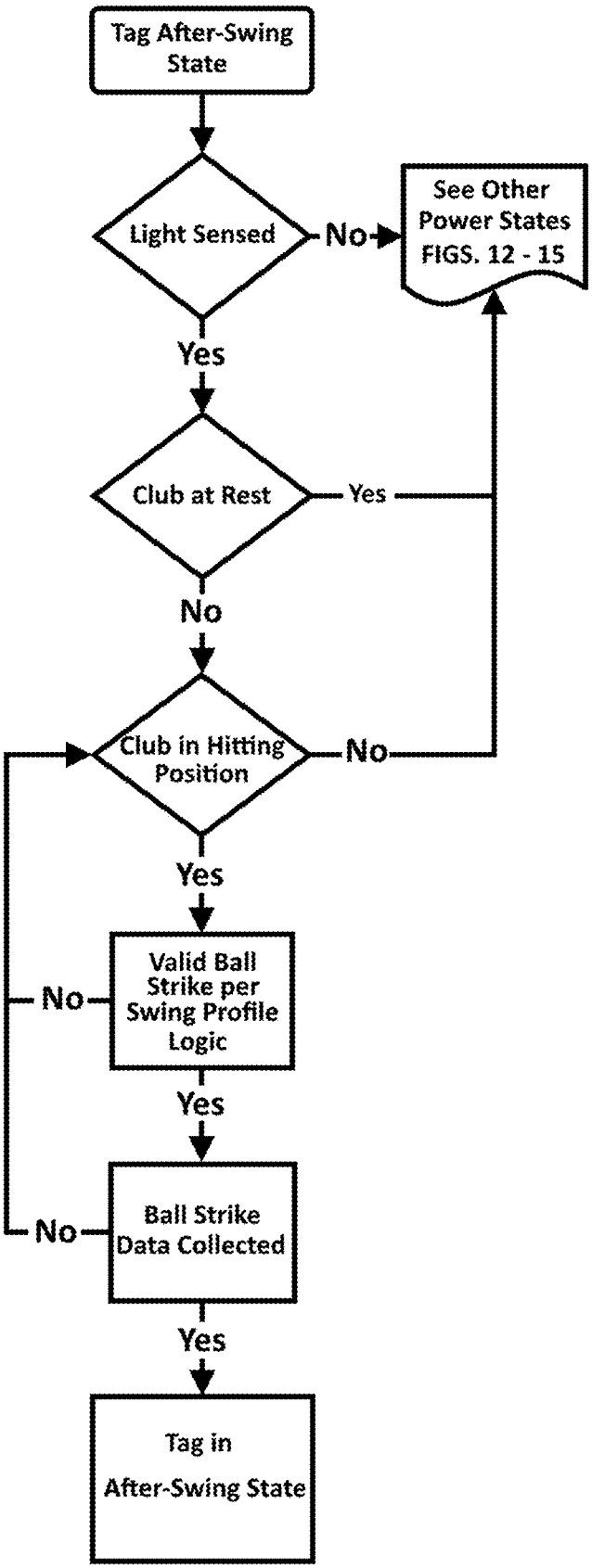
FIG. 16 illustrates a flowchart of the functional logic in a tag after-swing state power mode according to one embodiment of the present invention.

FIG. 16 illustrates a flowchart of the functional logic in an after-swing power state according to one embodiment of the present invention. The after-swing power state is configured to transmit collected data to a display device after and/or during a valid golf swing. In one embodiment, the after-swing state coexists with other power states. In one embodiment, in the after-swing power state, the tag device is operable to collect golf ball strike data and/or after swing or follow through swing data. In one embodiment, when an after-swing power state is entered, BLE is advertising aggressively to upload captured data to an interfacing or display device, regardless of subsequent power states. In one embodiment, aggressive advertising continues until the tag device is connected with an interfacing or display device and swing data has fully been transmitted to the display device and/or until the tag device is timed-out.

In one embodiment, an after-swing state is entered when a light environment is sensed, the golf club is determined to not be at rest, the golf club is determined to be in a hitting position, and/or the golf club is determined to have already struck a golf ball. Following the previously mentioned parameters, the after-swing state waits for a valid swing profile to be detected and a valid ball strike to be detected and then collects data associated with the valid swing and valid ball strike. In one embodiment, the after-swing state is operable to aggressively advertise swing data via BLE protocols to a display device. In one embodiment, the after-swing state returns to awaiting detection of a valid swing profile and valid ball strike when an invalid swing profile or ball strike is determined (i.e., a practice swing or a missed swing) by the accelerometer, magnetometer, and/or gyroscope. Similar to the previous power states, the after-swing power state can be configured to require various degrees of light sensed, motion sensed, and golf club position to enter an after-swing state. In one embodiment, an after-swing state is exited and a different power state is entered when a light environment is not sensed, the club is determined to be at rest, and/or the club is determined not to be in a hitting position.

Figure 17:
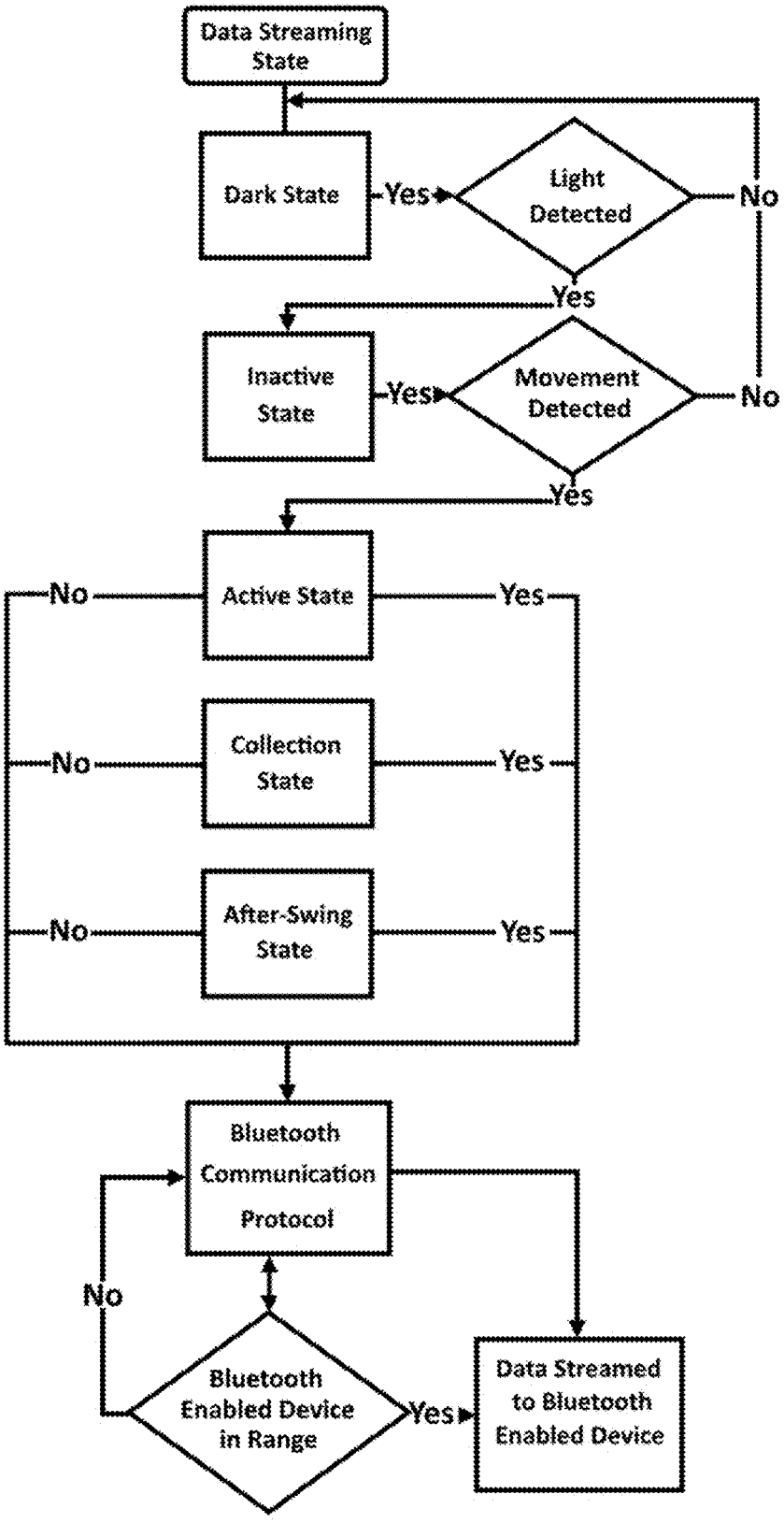
FIG. 17 illustrates a flowchart of the functional logic in a data streaming state power mode according to one embodiment of the present invention.

FIG. 17 illustrates a flowchart of the functional logic in a data streaming state power mode according to one embodiment of the present invention. In one embodiment, the streaming state is operable to coexist with other power states. In one embodiment, the data streaming state is operable to transmit sensor data in real-time to an interface, mobile, and/or display device regardless of the golf club's orientation, motion, and/or other power states. In one embodiment, a data streaming state is activated when a light environment is sensed, motion is detected, an active state is initiated, and BLE is advertising. In one embodiment, when a data streaming power state is activated and a display device is in range of the BLE, a connection is made that facilitates a data streaming command from the display device. In one embodiment, upon initiation of the data streaming power state, real-time raw sensor data from the tag device's plurality of sensors is continually transmitted to a display device, regardless of the golf club's orientation or movement. In this embodiment, this unidirectional streaming of sensor data continues until it is terminated by the interfacing device.

In one embodiment, the BLE protocol avoids traditional pairing protocols with display devices by implementing a power saving BLE protocol or calibration that does not require traditional device-to-device pairing. In this embodiment, prior to conducting a golf swing, a user calibrates their display device (e.g., a mobile device running an application) to the tag device. Calibration occurs by placing one's mobile device proximate to the tag device, which allows the mobile device to identify the unique characteristic, fingerprint, and/or hash of the tag device and/or its plurality of sensors (i.e., a different hash for each sensor or for each tag device). This allows the tag device to transmit sensor data directly to the mobile device through BLE protocols without having to set up a pairing code between the mobile device and the tag device. Therefore, when the tag device is in the data streaming state and the BLE protocols are aggressively advertising the sensor data, a mobile device that has already been calibrated to the tag device captures the sensor data without having to pair with the tag device. This is accomplished because the tag device includes the unique characteristic, fingerprint, and/or hash in its sensor data as it is aggressively advertising the sensor data. Therefore, the mobile device easily recognizes the sensor data as the desired sensor data from the tag device and capture it for visualization for the user. In one embodiment, the BLE protocol is operable to transmit sensor data without requiring device-to-device pairing. In this embodiment, a display device is operable to capture the transmitting data without pairing to the tag device. This embodiment functions to overall reduce the use of the microcontroller 102, which contains and runs the BLE protocol. In one embodiment, the fingerprint and/or is stored in non-volatile memory. In one embodiment, a mobile device running an application stores the tag device's fingerprint and/or hash. In one embodiment, a mobile device running an application recognizes a fingerprint when in range of the tag device. In one embodiment, after a valid swing has been detected and the swing data has been collected, the BLE advertises aggressively until the mobile device running an application responds, validates, and receives the plurality of swing data and/or until a predetermined timeout occurs (i.e., BLE advertises for an amount of time that indicates that data transfer will not occur). In one embodiment, where the BLE times out, the device is returned to a dark state.

In one embodiment, a user calibrates their tag device to the gold club to which it is affixed by placing the mobile device running an application on the face of the golf club in a set orientation and then moving the golf club in a set pattern. Using the gyroscope in the tag device and a gyroscope in the mobile device, specific parameters of the golf club, such as, length, loft, lie, and orientation is determined. This is accomplished because both the mobile device's gyroscope and the tag device's gyroscope are moving in a similar synchronous pattern. This process can be accomplished in a room of multiple golfers with multiple tag devices by having the tag device distinguish the movement patterns of its mobile device, affixed to its golf club, to other mobile devices, affixed to other's golf clubs. This cross correlation of gyroscope movement ensures that the mobile app recognizes and calibrates the appropriate tag device and in turn assigned a unique identifier number, fingerprint, and/or has.

More specifically, to accomplish the above-described calibration process, first the tag device is operating in an active state with the BLE advertising. Next, the mobile device is in range of the tag device and running an application compatible with the tag device. The mobile device running an application then activates the calibration mode, and the tag device enters into a data streaming mode where the plurality of sensors are activated and outputting sensor data. Next, the mobile device is placed on the face of the golf club in a specific orientation and moved, along with the tag device, in a specific pattern. The mobile device then receives the plurality of sensor data from the tag devices and compares it to the data received from the mobile devise sensors (e.g., the gyroscope). Then, the tag device with the cross correlated gyroscope data is recognized by the mobile device and the mobile device parses the data to create a unique identifier, fingerprint, and/or has that identifies the tag device as being on the specific gold club. Lastly, the mobile device writes that unique identifier, fingerprint, and/or has back to the tag device.

In one embodiment, using the BLE protocol described above, the unique characteristic, fingerprint, and/or hash connected to the sensor data of a specific tag device is shared with other display devices (e.g., tablet, TV, phone, etc.). This greatly reduces processing power needed by the tag device because the transfer of the unique fingerprint is accomplished by the mobile device rather than the tag device itself. This allows the BLE to function at a lower power rate for a longer time during a golf game while still being able to visualize swing data on a plurality of devices. In effect, power is conserved while function quality is maintained.

In one embodiment, using the BLE protocol described above, a plurality of tag device devices and mobile devices can share sensor data with each other while recognizing what sensor data is whose. As an example, multiple users each calibrate one or more tag devices to one or more mobile devices (using the pairing method described above) prior to beginning a golf game. Thereafter, when the golfers each conduct a first golf swing, the sensor data is transmitted to their respective mobile devices without the need for each golfer to find and pair a specific tag device (containing their individual strike data) to a specific mobile device. This allows the user to receive golf swing sensor data after each golf swing without having to pair a device, which would be further complicated by the presence of multiple tag devices and multiple mobile devices. By eliminating BLE pairing between the tag device and a mobile device the microcontroller's need for processing power is greatly reduced and in turn the battery life of the tag device is extended.

In one embodiment, using the BLE protocol described above, the tag device is operable to simultaneously display sensor data on multiple display device at once (i.e., on ones' tablet, phone, watch, etc.). Additionally, the tag device is operable to display sensor data on one or more display devices (e.g., TVs) in a golf hitting bay. In this embodiment, battery power is saved by avoiding BLE pairing with each individual display device, one at a time. This further reduces battery power by avoiding round robin communication (i.e., display devices having to "wait in line" to be paired to the tag device.

In one embodiment, the BLE protocol described above is further operable to implement a golf swing rejection protocol with a mobile device running a complimentary application to further reduce the processing power used by the tag device. In this embodiment, not only does the tag device identify itself to a mobile device with a unique fingerprint, the tag device identifies each individual golf swing and the sensor data associated with it with an additional unique fingerprint recognizable by the mobile device. This allows the mobile device to recognize what sensor data has already been received (thus rejecting any subsequent attempt to transmit it) and what sensor data is yet to be received. Furthermore, using this protocol, the amount of sensor data stored by the IMU 101 can be reduced.

As an example, the IMU is configured to only store five golf swings. In this example, the tag device has been pre-calibrated with a mobile device so that the mobile device has a unique identification number, ESN, fingerprint, and/or hash to identify sensor data associated with the tag device and has an additional unique identification number, ESN, fingerprint, and/or hash to identify for each golf swing, one to five. More specifically, golf swing sensor data one has a unique identification number that identifies it as coming from the tag device and identifying it as the sensor data associated with a first golf swing. Golf swing two, three, four, and five have similar identification numbers to the first golf swing and these identification numbers identify the data as coming from the specific tag device but having the added benefit of identify what number golf swing they represent in the sequence. Therefore, each consecutive golf swing is identified and captured by the mobile device during BLE protocol in an orderly fashion. What results is a reduction in processing power used by the IMU because it only stores five golf swings at a time. The IMU needs only store data associated with five golf swing because each golf swing sensor data point is transmitted to a mobile device. In this example, once the sixth golf swing is accomplished, the first golf swing data is overwritten and a similar process continues for subsequent golf swings. The mobile device is operable to reject any data it has already received and accept new golf swing data yet to be received. This embodiment serves to extend battery life by reducing processing power and serves to minimize the size and weight of the tag device by requiring less memory space.

Figure 18:
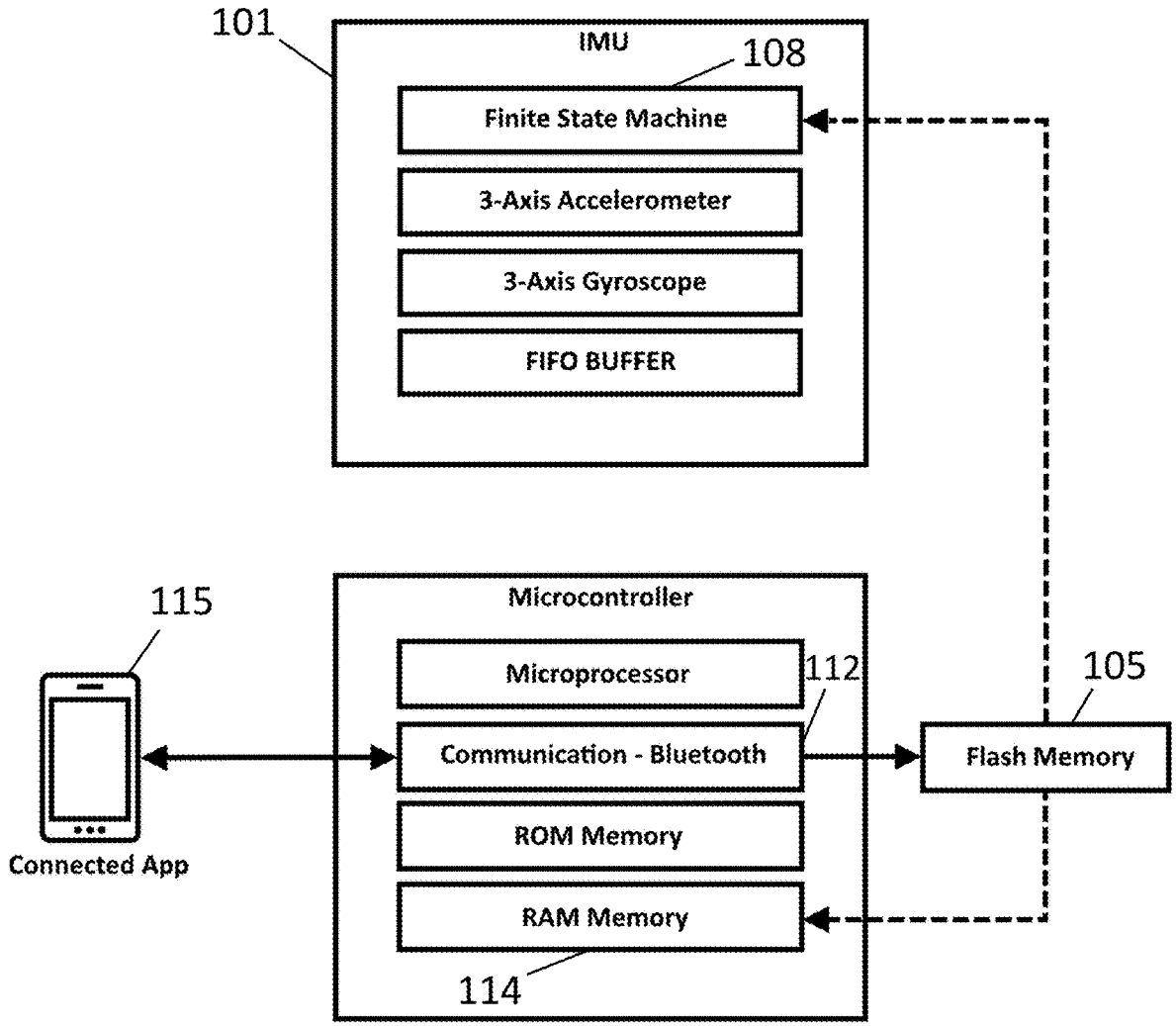
FIG. 18 illustrates a flowchart of the tag device where data is transferred to flash memory and distributed to non-volatile memory and registers of the tag device according to one embodiment of the present invention.

FIG. 18 illustrates a flowchart of the tag device where data is transferred to flash memory 105 and distributed to non-volatile memory and registers of the tag device according to one embodiment of the present invention. In one embodiment, updates to the operational code of the tag device are transmitted, stored by flash memory 105, and distributed to RAM memory 114, and registers to the finite state machine 108. In one embodiment, for the updates to the operational code of the tag device to be transmitted, the tag device must be in an active state, an after-swing state, and/or any state where BLE is advertising. In one embodiment, a mobile device app 115 connects to the tag device and transfers the updates to the operational code of the tag device to the flash memory 105 whereby the old operational code is overwritten by the new operational code. In one embodiment, the mobile device app 115 sends a reboot command to the tag device, which reboots and distributes the operation code to the finite state machine 108 and the RAM memory 114.

In one embodiment, the microprocessor 116 is operable to refresh the processing logic of the finite state machine 108 upon transition from one power state to another (e.g., from dark state to inactive state). Refreshing the processing logic of the finite state machine 108 is operable to instruct the IMU 101 to provide less, more, and/or the same amount of processing power to the plurality of sensors. Furthermore, using the microprocessor 116 to refresh the processing logic of the finite state machine 108, rather than using the ROM memory unit 113 or the RAM memory unit 114, results in less processing power being used by the microcontroller 102, which increases battery life.

In one embodiment, the flash memory unit 105 is operable to refresh the processing logic of the finite state machine 108 upon transition from one power state to another (e.g., from dark state to inactive state). Refreshing the processing logic of the finite state machine 108 is operable to instruct the IMU 101 to provide less, more, and/or the same amount of processing power to the plurality of sensors. Furthermore, using the flash memory unit 105 to refresh the processing logic of the finite state machine 108, rather than using the ROM memory unit 113 or the RAM memory unit 114, results in less processing power being used by the microcontroller 102, which increases battery life.

In a typical use case, the tag device will enter a dark state when the golf club it is affixed to is in a golf bag or in a dark environment. In a typical use case, the tag device is operable to transition from a dark state to an inactive state when the golf bag is removed from a golfer's car or otherwise carried around in a golf course. In a typical use case, the tag device is operable to transition from an inactive power state to an active power state when the golf club bag is set down in a tee box. In a typical use case, the tag device is operable to transition from an inactive power state to an active power state when the golf club is removed from its golf bag. In a typical use case, the tag device is operable to transition between active and inactive states when a golfer is moving a golf club in anticipation of conducting their next golf swing. In a typical use case, the tag device is operable to transition from an active power state to a collection power state when the golfer is in a position to strike a golf ball. In a typical use case, the tag device is operable to transition from a collection state to an after-swing state upon contact of the golf club to the golf ball. In a typical use case, the tag device is operable to transition from an after-swing power state to a streaming power state to transmit the swing data to a display device, such as a SKYCADDIE or a SKYTRAK. In a typical use case, the tag device is operable to transition to a plurality of different power states after each golf swing is completed.

Figure 19:
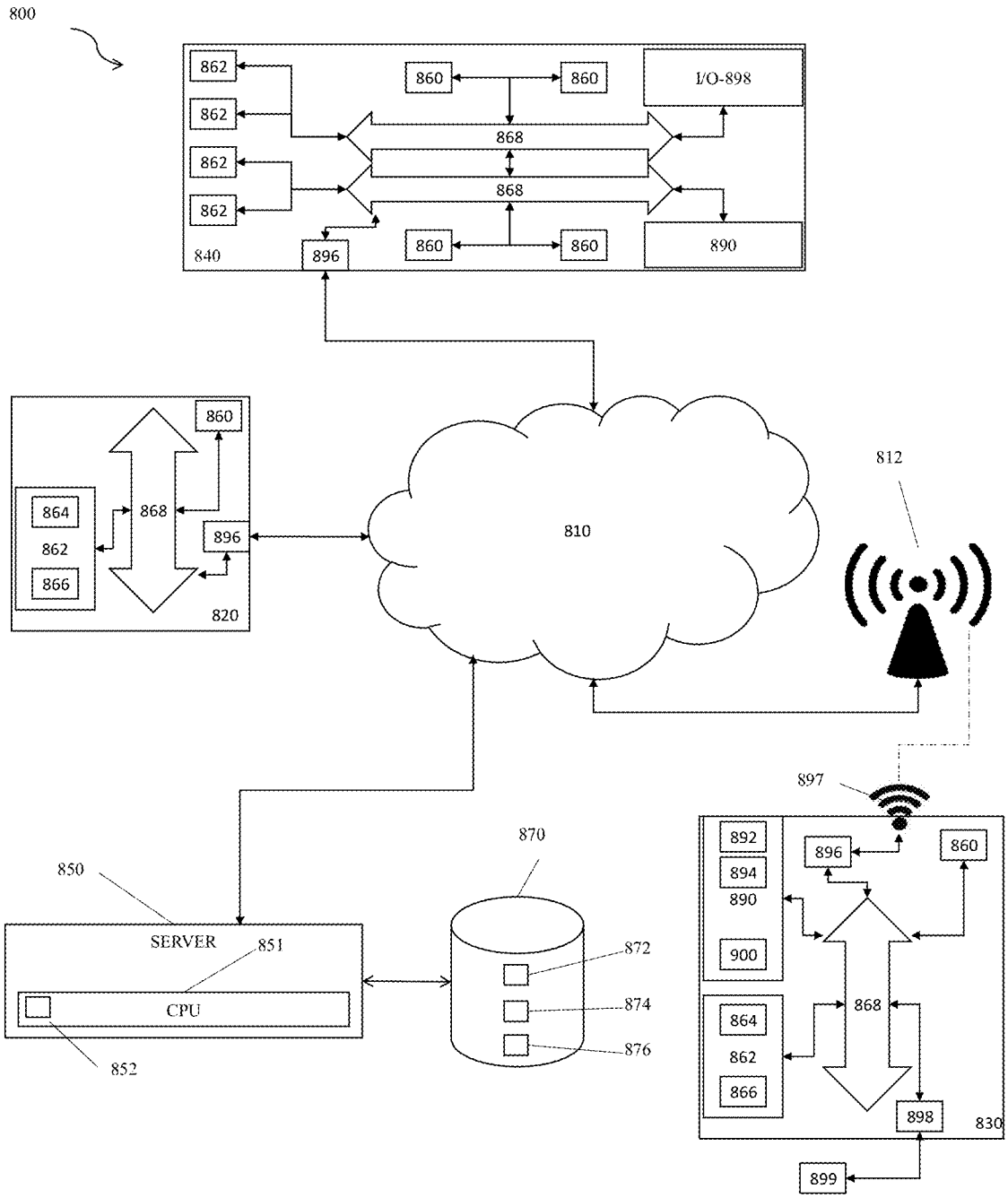
FIG. 19 is a schematic diagram of a system of the present invention.

FIG. 19 is a schematic diagram of an embodiment of the invention illustrating a computer system, generally described as 800, having a network 810, a plurality of computing devices 820, 830, 840, a server 850, and a database 870.

The server 850 is constructed, configured, and coupled to enable communication over a network 810 with a plurality of computing devices 820, 830, 840. The server 850 includes a processing unit 851 with an operating system 852. The operating system 852 enables the server 850 to communicate through network 810 with the remote, distributed user devices. Database 870 is operable to house an operating system 872, memory 874, and programs 876.

In one embodiment of the invention, the system 800 includes a network 810 for distributed communication via a wireless communication antenna 812 and processing by at least one mobile communication computing device 830. Alternatively, wireless and wired communication and connectivity between devices and components described herein include wireless network communication such as WI-FI, WORLDWIDE INTEROPERABILITY FOR MICROWAVE ACCESS (WIMAX), Radio Frequency (RF) communication including RF identification (RFID), NEAR FIELD COMMUNICATION (NFC), BLUETOOTH including BLUETOOTH LOW ENERGY (BLE), ZIGBEE, Infrared (IR) communication, cellular communication, satellite communication, Universal Serial Bus (USB), Ethernet communications, communication via fiber-optic cables, coaxial cables, twisted pair cables, and/or any other type of wireless or wired communication. In another embodiment of the invention, the system 800 is a virtualized computing system capable of executing any or all aspects of software and/or application components presented herein on the computing devices 820, 830, 840. In certain aspects, the computer system 800 is operable to be implemented using hardware or a combination of software and hardware, either in a dedicated computing device, or integrated into another entity, or distributed across multiple entities or computing devices.

By way of example, and not limitation, the computing devices 820, 830, 840 are intended to represent various forms of electronic devices including at least a processor and a memory, such as a server, blade server, mainframe, mobile phone, personal digital assistant (PDA), smartphone, desktop computer, netbook computer, tablet computer, workstation, laptop, and other similar computing devices. The components shown here, their connections and relationships, and their functions, are meant to be exemplary only, and are not meant to limit implementations of the invention described and/or claimed in the present application.

In one embodiment, the computing device 820 includes components such as a processor 860, a system memory 862 having a random access memory (RAM) 864 and a read-only memory (ROM) 866, and a system bus 868 that couples the memory 862 to the processor 860. In another embodiment, the computing device 830 is operable to additionally include components such as a storage device 890 for storing the operating system 892 and one or more application programs 894, a network interface unit 896, and/or an input/output controller 898. Each of the components is operable to be coupled to each other through at least one bus 868. The input/output controller 898 is operable to receive and process input from, or provide output to, a number of other devices 899, including, but not limited to, alphanumeric input devices, mice, electronic styluses, display units, touch screens, gaming controllers, joy sticks, touch pads, signal generation devices (e.g., speakers), augmented reality/virtual reality (AR/VR) devices (e.g., AR/VR headsets), or printers.

By way of example, and not limitation, the processor 860 is operable to be a general-purpose microprocessor (e.g., a central processing unit (CPU)), a graphics processing unit (GPU), a microcontroller, a Digital Signal Processor (DSP), an Application Specific Integrated Circuit (ASIC), a Field Programmable Gate Array (FPGA), a Programmable Logic Device (PLD), a controller, a state machine, gated or transistor logic, discrete hardware components, or any other suitable entity or combinations thereof that can perform calculations, process instructions for execution, and/or other manipulations of information.

In another implementation, shown as 840 in FIG. 19, multiple processors 860 and/or multiple buses 868 are operable to be used, as appropriate, along with multiple memories 862 of multiple types (e.g., a combination of a DSP and a microprocessor, a plurality of microprocessors, one or more microprocessors in conjunction with a DSP core).

Also, multiple computing devices are operable to be connected, with each device providing portions of the necessary operations (e.g., a server bank, a group of blade servers, or a multi-processor system). Alternatively, some steps or methods are operable to be performed by circuitry that is specific to a given function.

According to various embodiments, the computer system 800 is operable to operate in a networked environment using logical connections to local and/or remote computing devices 820, 830, 840 through a network 810. A computing device 830 is operable to connect to a network 810 through a network interface unit 896 connected to a bus 868. Computing devices are operable to communicate communication media through wired networks, direct-wired connections or wirelessly, such as acoustic, RF, or infrared, through an antenna 897 in communication with the network antenna 812 and the network interface unit 896, which are operable to include digital signal processing circuitry when necessary. The network interface unit 896 is operable to provide for communications under various modes or protocols.

In one or more exemplary aspects, the instructions are operable to be implemented in hardware, software, firmware, or any combinations thereof. A computer readable medium is operable to provide volatile or non-volatile storage for one or more sets of instructions, such as operating systems, data structures, program modules, applications, or other data embodying any one or more of the methodologies or functions described herein. The computer readable medium is operable to include the memory 862, the processor 860, and/or the storage media 890 and is operable be a single medium or multiple media (e.g., a centralized or distributed computer system) that store the one or more sets of instructions 900. Non-transitory computer readable media includes all computer readable media, with the sole exception being a transitory, propagating signal per se. The instructions 900 are further operable to be transmitted or received over the network 810 via the network interface unit 896 as communication media, which is operable to include a modulated data signal such as a carrier wave or other transport mechanism and includes any delivery media. The term "modulated data signal" means a signal that has one or more of its characteristics changed or set in a manner as to encode information in the signal.

Storage devices 890 and memory 862 include, but are not limited to, volatile and non-volatile media such as cache, RAM, ROM, EPROM, EEPROM, FLASH memory, or other solid state memory technology; discs (e.g., digital versatile discs (DVD), HD-DVD, BLU-RAY, compact disc (CD), or CD-ROM) or other optical storage; magnetic cassettes, magnetic tape, magnetic disk storage, floppy disks, or other magnetic storage devices; or any other medium that can be used to store the computer readable instructions and which can be accessed by the computer system 800.

In one embodiment, the computer system 800 is within a cloud-based network. In one embodiment, the server 850 is a designated physical server for distributed computing devices 820, 830, and 840. In one embodiment, the server 850 is a cloud-based server platform. In one embodiment, the cloud-based server platform hosts serverless functions for distributed computing devices 820, 830, and 840.

In another embodiment, the computer system 800 is within an edge computing network. The server 850 is an edge server, and the database 870 is an edge database. The edge server 850 and the edge database 870 are part of an edge computing platform. In one embodiment, the edge server 850 and the edge database 870 are designated to distributed computing devices 820, 830, and 840. In one embodiment, the edge server 850 and the edge database 870 are not designated for distributed computing devices 820, 830, and 840. The distributed computing devices 820, 830, and 840 connect to an edge server in the edge computing network based on proximity, availability, latency, bandwidth, and/or other factors.

It is also contemplated that the computer system 800 is operable to not include all of the components shown in FIG. 19 is operable to include other components that are not explicitly shown in FIG. 19 or is operable to utilize an architecture completely different than that shown in FIG. 19 The various illustrative logical blocks, modules, elements, circuits, and algorithms described in connection with the embodiments disclosed herein are operable to be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application (e.g., arranged in a different order or partitioned in a different way), but such implementation decisions should not be interpreted as causing a departure from the scope of the present invention.

Certain modifications and improvements will occur to those skilled in the art upon a reading of the foregoing description. The above-mentioned examples are provided to serve the purpose of clarifying the aspects of the invention and it will be apparent to one skilled in the art that they do not serve to limit the scope of the invention. All modifications and improvements have been deleted herein for the sake of conciseness and readability but are properly within the scope of the present invention.

The invention claimed is:

1. A device attachable to a golf club for measuring characteristics of a golf swing comprising:

an inertial measurement unit, a gyroscope, a magnetometer, a microcontroller including a microprocessor, a photosensor, and a battery;

wherein the inertial measurement unit is in communication with the magnetometer;

wherein the microcontroller is in communication with the inertial measurement unit and the photosensor;

wherein the device is initially in a dark state;

wherein in the dark state, the battery provides power to the photosensor;

wherein upon the photosensor detecting a predetermined threshold of light, the photosensor sends a communication to the microprocessor indicating the photosensor has detected the predetermined threshold of light;

wherein the microprocessor instructs the device to transition from the dark state to an inactive state;

wherein in the inactive state, the battery provides power to an accelerometer of the inertial measurement unit but does not provide power to the gyroscope;

wherein, upon the accelerometer detecting motion of the device above a predetermined threshold, the accelerometer communicates a notification regarding the motion above the predetermined threshold to the microprocessor;

wherein, upon the microprocessor receiving the notification regarding the motion above the predetermined threshold, the microprocessor instructs the device to transition from the inactive state to an active state;

wherein upon the accelerometer detecting an orientation of the device indicating the golf club is in a pre-swing state, the accelerometer sends a notification to the microprocessor;

wherein the pre-swing state is indicated when the accelerometer detects an acceleration above a first preset threshold in a z-axis or an adjusted z-axis, and detects a total acceleration below a second preset threshold;

wherein, upon the microprocessor receiving the notification from the accelerometer, the microprocessor instructs the device to transition from the active state to a data collection state;

wherein in the data collection state, the battery provides power to the gyroscope of the inertial measurement unit and to the accelerometer and the magnetometer; and wherein in the data collection state, the magnetometer measures an orientation of the device, the gyroscope measures a rate of rotation of the device, and the accelerometer measures motion of the device.

2. The device of claim 1, wherein the microcontroller includes at least one communication unit, operable to communicate wirelessly according to a BLUETOOTH LOW-ENERGY (BLE) protocol with at least one user device.

3. The device of claim 2, wherein messages transmitted by the at least one communication unit to the at least one user device including metadata providing an identification number of the device transmitting the messages.

4. The device of claim 2, wherein the at least one user device includes a plurality of user devices, and wherein the at least one communication unit transmits sensor data including measurements from the magnetometer, the accelerometer, the photosensor and/or the gyroscope to the plurality of user devices simultaneously.

5. The device of claim 1, wherein the inertial measurement unit includes a finite state machine.

6. The device of claim 1, wherein, in the data collection state, the inertial measurement unit allocates power to a communication unit of the microcontroller, wherein the communication unit is operable to transmit sensor data from the magnetometer, the accelerometer, the photosensor and/or the gyroscope to at least one user device.

7. The device of claim 6, wherein, in an after-swing state, the inertial measurement unit allocates increased power to the communication unit of the microcontroller relative to the power allocated in the data collection state.

8. The device of claim 1, wherein the microprocessor instructs the device to transition to the dark state when the photosensor detects a light intensity below a minimum required light intensity.

9. A device attachable to a golf club for measuring characteristics of a golf swing comprising:

an inertial measurement unit, a magnetometer, a microcontroller including a microprocessor, a photosensor, and a battery;

wherein the inertial measurement unit is in communication with the magnetometer;

wherein the microcontroller is in communication with the inertial measurement unit and the photosensor;

wherein the device is initially in a dark state;

wherein upon the photosensor detecting a predetermined threshold of light, the photosensor sends a communication to the microprocessor indicating the photosensor has detected the predetermined threshold of light;

wherein the microprocessor instructs the device to transition from the dark state to an inactive state;

wherein, upon an accelerometer of the inertial measurement unit detecting motion of the device above a predetermined threshold, the accelerometer communicates a notification regarding the motion above the predetermined threshold to the microprocessor;

wherein, upon the microprocessor receiving the notification regarding the motion above the predetermined threshold, the microprocessor instructs the device to transition from the inactive state to an active state;

wherein upon the accelerometer detecting an orientation of the device indicating the golf club is in a pre-swing state, the accelerometer sends a notification to the microprocessor;

wherein, upon the microprocessor receiving the notification from the accelerometer, the microprocessor instructs the device to transition from the active state to a data collection state;

wherein in the data collection state, the magnetometer measures an orientation of the device, a gyroscope of the inertial measurement unit measures a rate of rotation of the device, and the accelerometer measures motion of the device;

wherein the microcontroller includes at least one communication unit, operable to communicate wirelessly according to a BLUETOOTH LOW-ENERGY (BLE) protocol with at least one user device; and wherein messages transmitted to the at least one user device by the at least one communication unit include sensor data from the magnetometer, the accelerometer, the photosensor and/or the gyroscope to at least one user device in real time.

10. The device of claim 9, wherein messages transmitted by the at least one communication unit to the at least one user device including metadata providing an identification number of the device transmitted the messages.

11. The device of claim 9, wherein the at least one user device includes a plurality of user devices, and wherein the at least one communication unit transmits sensor data including measurements from the magnetometer, the accelerometer, the photosensor and/or the gyroscope to the plurality of user devices simultaneously.

12. The device of claim 9, wherein the microprocessor instructs the device to transition to the dark state when the photosensor detects a light intensity below a minimum required light intensity.

13. A method for measuring characteristics of a golf swing comprising:

attaching a tag device to a golf club;

the tag device including an inertial measurement unit, a magnetometer, a microcontroller including a microprocessor, a photosensor, a gyroscope, and a battery;

the microcontroller being in communication with the inertial measurement unit, and the photosensor;

the device initially being in a dark state;

the battery providing power to the photosensor while in the dark state;

upon the photosensor detecting a predetermined threshold of light, the photosensor sending a communication to the microprocessor indicating the photosensor has detected the predetermined threshold of light;

the microprocessor sending an instruction to the device to transition from the dark state to an inactive state;

the battery increasing power to an accelerometer of the inertial measurement unit and not providing power to the gyroscope while in the inactive state;

upon the accelerometer detecting motion of the device above a predetermined threshold, the accelerometer communicating a notification regarding the motion above the predetermined threshold to the microprocessor;

upon the microprocessor receiving the notification regarding the motion above the predetermined threshold, the microprocessor instructing the device to transition from the inactive state to an active state;

upon the accelerometer detecting an orientation of the device indicating the golf club is in a pre-swing state, the accelerometer sending a notification to the microprocessor, wherein the pre-swing state is indicated when the accelerometer detects an acceleration above a first preset threshold in a z-axis or an adjusted z-axis, and detects a total acceleration below a second preset threshold;

upon the microprocessor receiving the notification from the accelerometer, the microprocessor instructing the device to transition from the active state to a data collection state;

the battery providing power to the gyroscope of the inertial measurement unit and providing power to the accelerometer and the magnetometer while in the data collection state; and while in the data collection state, the magnetometer measuring an orientation of the device, the gyroscope measuring a rate of rotation of the device, and the accelerometer measuring motion of the device.

14. The method of claim 13, further comprising the microcontroller including at least one communication unit, and the at least one communication unit communicating wirelessly according to a BLUETOOTH LOW-ENERGY (BLE) protocol with at least one user device.

15. The method of claim 14, further comprising the at least one communication unit transmitting sensor data including measurements from the magnetometer, the accelerometer, the photosensor and/or the gyroscope to at least one user device in real time.

16. The method of claim 14, further comprising messages transmitted by the at least one communication unit to the at least one user device including metadata providing an identification number of the device transmitted the messages.

17. The method of claim 14, further comprising the at least one user device including a plurality of user devices, and the at least one communication unit transmitting sensor data from the magnetometer, the accelerometer, the photosensor and/or the gyroscope to the plurality of user devices simultaneously.

18. The method of claim 13, further comprising the inertial measurement unit allocating power to a communication unit of the microcontroller while in the data collection state, wherein the communication unit is operable to transmit sensor data from the magnetometer, the accelerometer, the photosensor and/or the gyroscope to at least one user device.

19. The method of claim 18 further comprising the inertial measurement unit allocating increased power to the communication unit of the microcontroller relative to the power allocated in the data collection state while in an after-swing state.

20. The method of claim 13, further comprising the microprocessor instructing the device to convert to the dark state when the photosensor detects a light intensity below a minimum required light intensity.

* * * * *